US010315292B2

(12) United States Patent
Chen et al.

(10) Patent No.: US 10,315,292 B2
(45) Date of Patent: Jun. 11, 2019

(54) POWER TOOL

(71) Applicant: POSITEC POWER TOOLS (SUZHOU) CO., LTD, Suzhou, Jiangsu Province (CN)

(72) Inventors: Zhi Chen, Suzhou (CN); Xiangjin Du, Suzhou (CN); Wang Huo, Suzhou (CN); Mingjian Xie, Suzhou (CN); Yichun Ma, Suzhou (CN); Xiaoli Pang, Suzhou (CN)

(73) Assignee: POSITEC POWER TOOLS (SUZHOU) CO., LTD, Suzhou, Jiangsu Province (CN)

( * ) Notice: Subject to any disclaimer, the term of this patent is extended or adjusted under 35 U.S.C. 154(b) by 0 days.

(21) Appl. No.: 14/913,852

(22) PCT Filed: Aug. 22, 2014

(86) PCT No.: PCT/CN2014/085052
§ 371 (c)(1),
(2) Date: Feb. 23, 2016

(87) PCT Pub. No.: WO2015/024530
PCT Pub. Date: Feb. 26, 2015

(65) Prior Publication Data

US 2016/0207178 A1 Jul. 21, 2016

(30) Foreign Application Priority Data

Aug. 23, 2013 (CN) ..... 2013 1 0372898
Apr. 10, 2014 (CN) ..... 2014 1 0140188
May 16, 2014 (CN) ..... 2014 1 0209417

(51) Int. Cl.
*B25B 21/00* (2006.01)
*B25B 13/48* (2006.01)

(52) U.S. Cl.
CPC ..... *B25B 21/00* (2013.01); *B25B 13/481* (2013.01)

(58) Field of Classification Search
CPC ..... B23B 31/123; B25B 1/00; B25B 13/481
(Continued)

(56) References Cited

U.S. PATENT DOCUMENTS 5,100,271 A 3/1992 Kameyama et al.
5,125,673 A * 6/1992 Huff ..... B23B 31/1207 279/60

(Continued)

FOREIGN PATENT DOCUMENTS

CN 2637112 Y 9/2004
CN 201108971 Y 9/2008

(Continued)

OTHER PUBLICATIONS

International Search Report and Written Opinion for PCT/CN2014/085052 filed Aug. 22, 2014 and mailed from the International Bureau dated Nov. 18, 2014, 13 pgs.

*Primary Examiner* — Chelsea E Stinson
(74) *Attorney, Agent, or Firm* — Stoel Rives LLP

(57) ABSTRACT

A power tool comprises a housing (1), a motor (2) provided inside the housing and for outputting rotary power, and an output shaft (4) driven by the motor to rotate. The output shaft has an output end connected to a drill bit (9) and a second end provided on the other end of the output shaft; in a non-working state, the output shaft can axially move relative to the housing along the output shaft; and in a working state, the output shaft is limited in moving in a first axial direction, the first axial direction being an axial direction from the output end to the second end. The drill bit of the power tool can extend in different length according to different positions of the output shaft, so that a working (Continued)

mode is rapidly switched in different working conditions, especially in a small space.

8 Claims, 26 Drawing Sheets

(58) Field of Classification Search
USPC ..... 173/105
See application file for complete search history.

(56) References Cited

U.S. PATENT DOCUMENTS 7,588,398 B2 * 9/2009 Puzio ..... B23B 31/1253 279/135
7,645,101 B2 * 1/2010 Puzio ..... B23B 31/123 279/62
7,690,658 B2 * 4/2010 Puzio ..... B23B 31/1253 279/134
9,248,507 B2 * 2/2016 Roehm ..... B23B 31/008
9,421,681 B2 * 8/2016 Zhang ..... B25F 5/029
9,833,884 B2 * 12/2017 Andriolo ..... B25F 5/029
10,093,004 B2 * 10/2018 Andriolo ..... B25F 5/029
2005/0031424 A1 2/2005 Hernandez, Jr. et al.
2006/0291966 A1 * 12/2006 Klemm ..... B23B 45/008 408/124
2008/0134840 A1 6/2008 Shibata et al.
2010/0236805 A1 * 9/2010 Saur ..... B25B 21/00 173/216
2013/0032368 A1 * 2/2013 Zhang ..... B25F 5/029 173/1
2013/0178331 A1 * 7/2013 Saur ..... F16H 1/28 477/15
2014/0329654 A1 * 11/2014 Andriolo ..... B25F 1/04 483/1

FOREIGN PATENT DOCUMENTS

CN 203030966 U 7/2013
EP 1008227 A1 6/2000
EP 2457693 A2 5/2012
WO 9910965 A1 3/1999
WO 2009129611 A2 10/2009

* cited by examiner

POWER TOOL

FIELD OF THE INVENTION

The present invention relates to a power tool, and in particular, to a gun-drill type power tool available in various working conditions.

DESCRIPTION OF RELATED ART

Conventional gun-drill type power tools generally include electric drills, electric screw drivers and percussion drills.

An electric screw driver is a common electric tool used to tighten up a screw on a work piece. When it is needed to operate in different working conditions during use, for example, a screw is to be tightened up to a narrow portion of a work piece, the length of the tool bit is too short to reach the screw, a longer tool bit, that is, a bit needs to be replaced; in other words, the originally mounted tool bit is separated, and a longer tool bit is mounted, or an accessory adapter is additionally purchased, and the tool bit is mounted to the adapter when required and then the adapter is mounted to the electric screw driver. In a use situation in which tool bits need to be replaced frequently, great inconvenience is caused for an operator, on one hand, it is complicated to replace tool bits or replace accessories, and on the other hand, the separated tool bit or adapter is easily lost while being placed randomly. Some hand tools can implement storage and quick replacement of tool bits; however, due to inherent defects of the hand tools such as a small torque and laborious operation, the operator is easily tired, resulting in low efficiency, and the hand tools are inapplicable to be used as professional tools in industrial production.

SUMMARY OF THE INVENTION

To overcome the defects in the prior art, the present invention provides a power tool power tool available in various working conditions.

The present invention adopts the following technical scheme to solve the problem: A power tool, comprising: a housing; a motor a motor arranged in the housing and being configured to be capable of outputting a rotary force; and an output shaft being configured to be rotatably driven by the motor, the output shaft having a first output end for coupling with a tool bit and a second terminal end opposite to the first output end; wherein the output shaft is configured to be axially movable with respect to the housing when the power tool is in a non-working status; an axial movement of the output shaft along a first axial direction is restricted when the power tool is in a working status, the first axial direction is a direction from the first output end to the second terminal end.

Preferably, the axial movement of the output shaft along a second axial direction is restricted when the power tool is in working status, the second axial direction is a direction opposite to the first axial direction.

Preferably, the output shaft comprises two different work positions along the axial direction of the output shaft.

Preferably, the output shaft comprises at least three different work positions in the axial direction of the output shaft.

Preferably, there is a clearance within two adjacent work positions in the axial direction of the output shaft.

Preferably, the output shaft is axially movable within a predetermined section and the output shaft is selectively restricted in any position of the predetermined section.

Preferably, the power tool further comprises a restricting mechanism being configured to be in a releasing status and a locking status, the axial movement of the output shaft along the first direction is restricted when the restricting mechanism is in the locking status.

Preferably, the restricting mechanism is capable of driving the output shaft to move axially when the restricting mechanism is in the releasing status.

Preferably, the power tool comprises a frame member axially fixed in the housing and a locking member coupled to the output shaft; the restricting mechanism comprises a positioning part disposed in the frame member, a locking part disposed in the locking member, and a positioning member being capable of locking or releasing the positioning part and the locking part in the axial direction of the output shaft; the positioning member is configured to be in a first position on where the positioning part and the locking part are locked and a second position from where the locking of the positioning part and the locking part are released.

Preferably, the locking member is axially fixed with the output shaft.

Preferably, the restricting mechanism further comprises a locating control assembly for controlling the positioning member to move between the first position and the second position.

Preferably, the locating control assembly comprises a push member which is configured to be movable between a first section and a second section, the push member keeps locking of the positioning part and the locking part in the first section and keep releasing of the positioning part and the locking part in the second section.

Preferably, the push member is configured to be movable along the radial direction of the output shaft.

Preferably, the push member comprises a guide surface, when the positioning member is abutting on the guide surface; the push member is movable along the axial direction of the output shaft to drive the positioning member moving along the radial direction of the output shaft.

Preferably, the guide surface being configured as curved surface or an inclined surface which is inclined with respect to output shaft.

Preferably, the push member further provides a plane which is parallel to the axial direction of the output shaft, the guide surface adjoins the plane.

Preferably, the guide surface comprises a first guide section which is located at a first side of a normal plane perpendicular to the output shaft, and a second guide section which is located at a second side of the normal plane, the plane comprises a first plane section and a second plane section, the first plane section, the first guide section, the second plane section and the second guide section are joined in turn.

Preferably, the push member comprises a third inclined surface, the positioning member comprises a forth inclined surface disposed at an end of the positioning member adjacent to the push member, the third inclined surface is static with respect to the forth inclined surface under the action of static friction force.

Preferably, the frame member is configured as a sleeve disposed between the output shaft and the motor, the sleeve is driven by the motor to rotate, at least a part of the output shaft is disposed in the sleeve and driven by the sleeve to rotate, the locking member is fixed with the output shaft.

Preferably, the locating control assembly further comprises a loop sleeved outside the sleeve, the push member supported rotatably in the loop and drives the push member moving.

Preferably, the loop comprises a neck slot disposed in the inner wall of the loop, the push member having a clamping portion matching with the neck slot, the frame member comprises a groove extended axially throughout which the clamping portion clamping with the neck slot.

Preferably, the restricting mechanism further comprises an operating component associated with the housing; the operating component is configured to move the push member.

Preferably, the operating component comprises an operating unit disposed outside the housing; the operating unit is configured to be movable along with the axial direction of the output shaft.

Preferably, the operating component further comprises a connecting unit coupled the operating unit with the push member.

Preferably, the push member is capable of moving along the radial direction of the output shaft.

Preferably, the operating unit comprises a second resist surface, a second bevel surface connected with the second resist surface, the push member comprises a first resist surface and a first bevel surface connected with the first resist surface, the first bevel surface resist with the second bevel surface when the push member is in the locking position, the first resist surface resist with the second resist surface when the push member is in the releasing position.

Preferably, the locating control assembly further comprises a return member for allowing the push member having a tendency to return from the second section to the first section.

Preferably, the return member is configured as a first spring.

Preferably, the first spring disposed between the push member and frame member.

Preferably, the first spring disposed between the push member and locking member.

Preferably, the locking member provides with a first block arm and a second block arm located at one end remote from the tool bit, the push member provides with a first push arm and a second push arm corresponding to the first block arm and the second block arm respectively, the first spring having a first end and a second end; when the first push arm resist against the first end of the first spring, the second end resist against the second block arm; when the second push arm resist against the second end of the first spring, the first end of the spring resist against the first block arm.+

Preferably, the locating control assembly further comprises a reset unit for applying a force on the positioning member along a first direction opposite to a second direction on which the push member applying a force on the positioning member.

Preferably, the reset unit is configured as a second spring.

Preferably, the second spring disposed between the locking part and the positioning member.

Preferably, the frame member is fixed in the housing, a terminal end of the output shaft remote from the tool bit is rotatably supported on the locking member which drives the output shaft to move axially.

Preferably, the frame member is configured as a sleeve disposed between the output shaft and the motor, the sleeve driven by the motor to rotate, the output shaft located in the sleeve and driven by the sleeve to rotate.

Preferably, the power tool further comprises a transmission mechanism disposed between the motor and sleeve; the transmission mechanism transmits the rotation of the motor to the sleeve.

Preferably, the transmission mechanism comprises a cylindrical gear for connecting with the sleeve in a torque transmission way, a hole is provided on the cylindrical gear for transferring the torque from the sleeve, the sleeve is capable of moving in the hole and provides with a receiving part engaged with the hole of the cylindrical gear.

Preferably, the locking member is fixed on the output shaft.

Preferably, the locking member is configured as a locking arm fixed on the terminal end of the output shaft remote from the tool bit.

Preferably, the positioning part comprises at least two positioning holes designed in the inner wall of the frame member; the locking part is configured as a locking hole, the positioning member located in the locking hole and could be set partly in one of the positioning holes.

Preferably, the positioning part is configured as a positioning slot extended radially which fixed on the frame member; the locking part is configured as a restricting tooth located at a radial end of the locking member, the positioning member located in the positioning slot and comprises at least two restricting tooth portions for restricting the restricting tooth move axially.

Preferably, the frame member is circumferentially fixed in the housing, the locking member is fixed on the output shaft.

Preferably, the locking member and the positioning member are static with respect to each other in the axial direction of the output shaft; when the locking member engaged with the positioning member in the radial direction of the output shaft, the output shaft is configured to drive the locking member rotating, the locking member is configured to drive the positioning member rotating, and the positioning member is movable with respect to the positioning part along the axial direction of the output shaft; when the locking member disengaged from the positioning member along the radial direction of the output shaft, the positioning member and the positioning part are locked in the axial direction of the output shaft.

Preferably, the frame member is capable of moving along the radial direction of the output shaft with respect to the housing, the frame member drives the positioning member to move along the radial direction of the output shaft such that the positioning member could engaged with or separated from the locking part.

Preferably, the housing comprises a radially distributed guide rail, the frame member comprises a positioning sliding block which is slideable in the guide rail.

Preferably, the positioning member comprise a baffle which restricting the movement of the locking member with respect to the positioning member.

Preferably, the locking member comprises a gear part, the positioning member is provided with a gear ring part matching with the gear part.

Preferably, the positioning member and the frame member are in threaded connection.

Preferably, the positioning member is movable axially to disengaged from the positioning part, the output shaft and the positioning member are relatively static axially.

Preferably, the restricting mechanism further comprises a seventh elastic member make the positioning member tend to move toward the positioning part.

Preferably, the power tool further comprises a transmission mechanism disposed between the motor and output shaft; the transmission mechanism converted the rotation of the motor to the output shaft.

Preferably, the transmission mechanism comprises a cylindrical gear for connecting with the output shaft, the cylindrical gear provides with a hole for transferring the torque from the output shaft, the output shaft is capable of moving in the hole and provides with a receiving part engaged with the hole of the cylindrical gear.

Preferably, the output shaft comprises a first work position adjacent to the housing and a second work position remote to the housing, the restricting mechanism comprises a restricting member operated to restrict or allow the movement of the restricting member along the axial direction of the output shaft.

Preferably, the restricting member having a releasing position and a locking position, wherein the restricting member restricts the axial movement of the output shaft, the restricting mechanism further comprises an unlocking block for driving the restricting member to move from the locking position to the releasing position.

Preferably, the restricting mechanism further comprises a spring member abutting against the restricting member tend to the locking position.

Preferably, the unlocking block comprises an unlocking portion, the restricting member comprises an abutting part which is inclined with respect to the unlocking portion and cooperates to the unlocking portion, the abutting part is configures to be driven by the unlocking portion and then driving the restricting member to move.

Preferably, the output shaft comprises a supporting block axially fixed on an terminal end which is remote from the tool bit, the output shaft rotatably supported on the supporting block, the restricting block is axially abutted against the support block when the restricting member disposed at the locking position.

Preferably, the unlocking block coupled with the supporting block in a sliding way along with the axial of the output shaft, the unlocking block drive the supporting block to move when the restricting member is in the releasing position.

Preferably, the restricting member comprises a first clamping jaw and a second clamping jaw axially spaced apart from the first clamping jaw along the axial direction of the output shaft, when the output shaft located at the second work position, movement of the output shaft toward the first work position is restricted by the first clamping jaw restricts, when the output shaft located at the first work position, movement of the output shaft toward the second work position is restricted by the second clamping jaw.

Preferably, the housing comprises a transmission housing for accommodating the transmission mechanism, the restricting mechanism further comprises a restricting stiffened plate disposed on the housing and a stop portion disposed on the transmission housing, the restricting stiffened plate abutting against the supporting block axially such that restricting the movement of the output shaft from the second work position toward the first work position when the output shaft located at the first work position; the stop portion abutting against the supporting block axially such that restricting the movement of the output shaft from the first work position toward the second work position when the output shaft located at the second work position.

Preferably, an ejecting mechanism abutting against the output shaft disposed between the housing and output shaft, the ejecting mechanism stores an elastic force when the output shaft 4 is located in the first working position; the elastic force of the ejecting mechanism is released when the output shaft 4 is located in the second working position.

Preferably, the restricting mechanism further comprises an operating unit disposed outside the housing, the axial movement of the operating unit drives the unlocking block to move along the axial direction of the output shaft.

Preferably, the restricting mechanism further comprises an operating unit disposed on the housing, a pivot movement of the operating unit with respect to the housing drives the unlocking block to move along the axial direction of the output shaft.

Preferably, a reset spring disposed between the unlocking block and housing, the reset spring abutting against the unlocking block opposite to the direction which the operating unit drives the unlocking block to move.

Preferably, the unlocking block connected with the operating unit through a flexible connector, the unlocking block and the operating unit are disposed axially spaced apart along the axially direction of the output shaft.

Preferably, the axial distance between the first work position and second work position is more than 25 mm.

The present invention has the advantages after comparing with the prior arts. The core idea of the power tool of the present invention lies in that by setting the output shaft in different working positions, the tool bit may have different extension length, thereby meeting requirements in different working conditions.

Additional aspects and advantages will be apparent from the following detailed description of preferred embodiments, which proceeds with reference to the accompanying drawings.

BRIEF DESCRIPTION OF THE DRAWINGS

The disclosure will become more fully understood from the detailed description given herein below for illustration only, and thus are not limitative of the disclosure, and wherein.

DETAILED DESCRIPTION OF PREFERRED EMBODIMENTS

In the preferred implementation manner of a power tool of the present invention, the power tool is a power screw driver. The power screw driver may be classified into a pneumatic screw driver, a hydraulic screw driver, and an electric screw driver according to different power sources. The electric screw driver may be classified into a DC type and an AC type, and in the present invention, preferably, a DC type electric screw driver is used as an example for specific illustration.

FIG. 1 to FIG. 9 show a first preferred implementation manner of the present invention.

Figure 1:
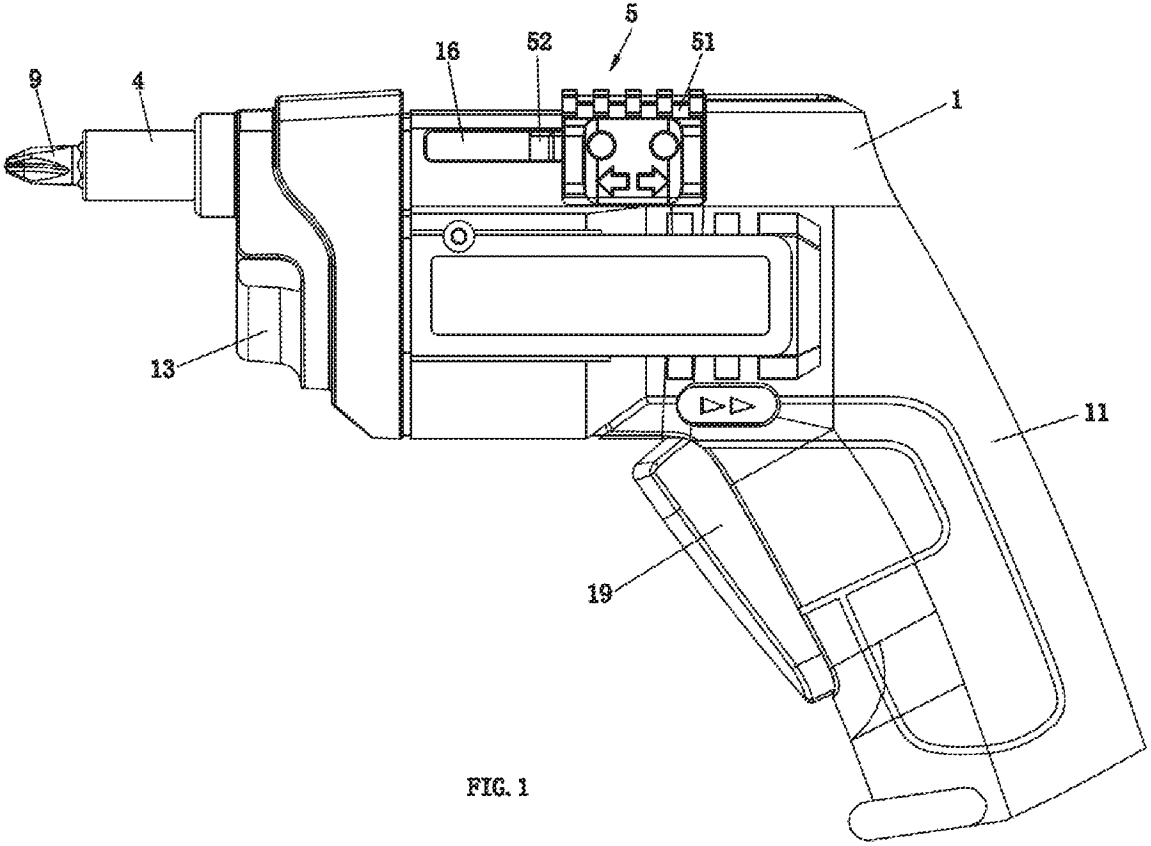
FIG. 1 is a front diagram of a power tool according to a preferred first implementation manner of the present invention.
Figure 2:
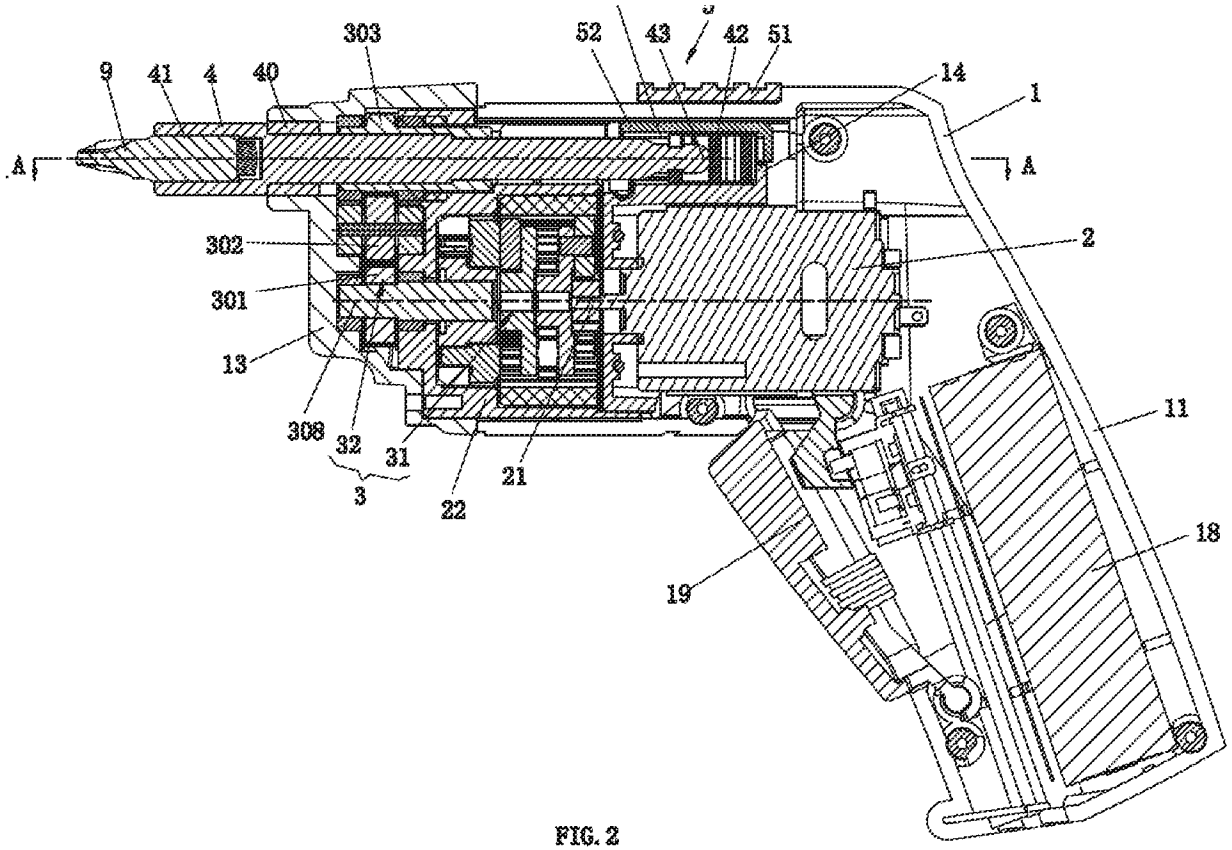
FIG. 2 is a sectional diagram of the power tool in FIG. 1 when an output shaft is in a first working position.
Figure 3:
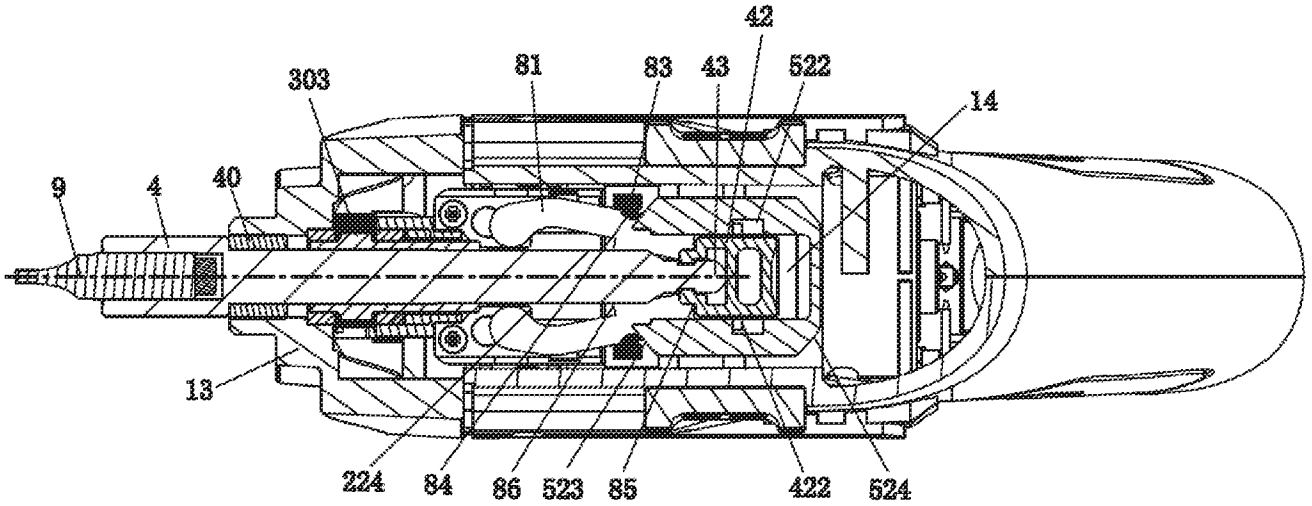
FIG. 3 is a schematic sectional diagram of the power tool in FIG. 2 made along a line A-A.
Figure 4:
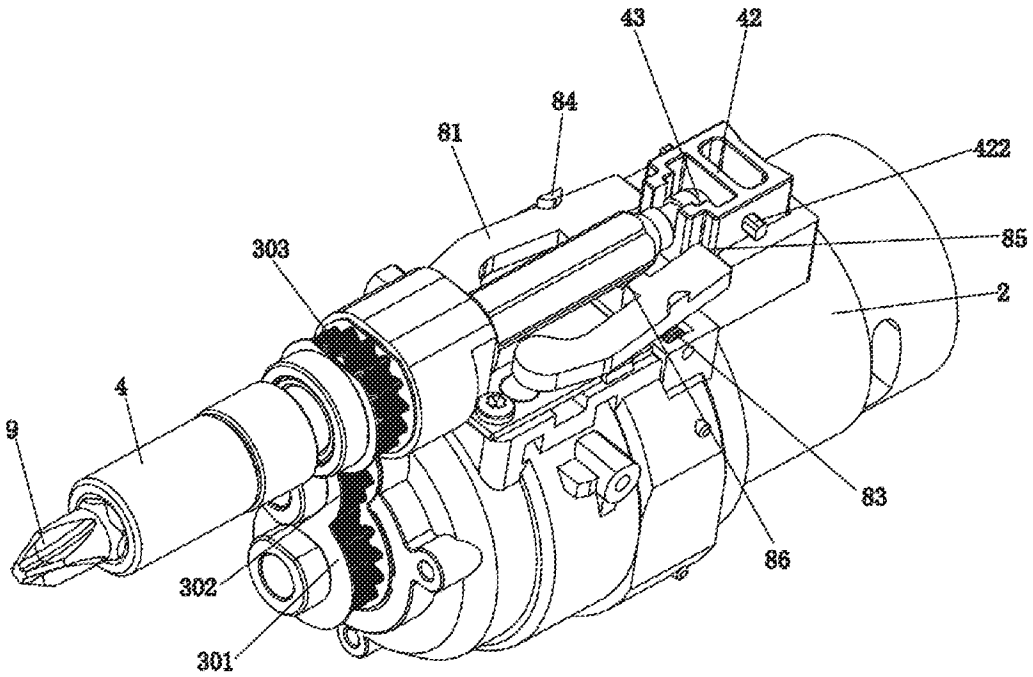
FIG. 4 is a three-dimensional diagram of the power tool in FIG. 2 after a housing is separated.
Figure 5:
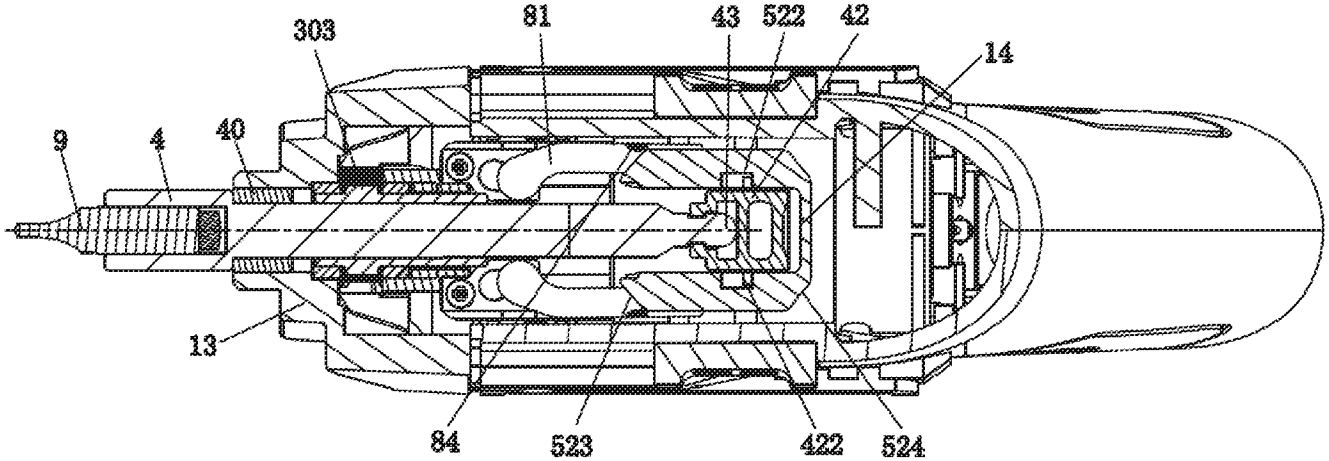
FIG. 5 is a three-dimensional diagram of the output shaft in FIG. 2 of which locking of an axial movement is released.

Referring to FIG. 1, the DC type electric screw driver includes a housing 1, a motor 2, a battery 18, a transmission mechanism 3, and an output shaft 4.

The housing 1 is formed by combining and assembling two half shells symmetric to each other with a screw (not shown), and has a horizontal part and a handle 11 part arranged to form an obtuse angle K with the horizontal part; in the present invention, the angle K is preferably between 100 degrees and 130 degrees, and in this way, the handle 11 is held comfortably during operation. A button switch 19 is disposed on the upper portion of the handle 11 part, the battery is fixed at the rear portion of the handle 11 part, and the transmission mechanism 3 is received in the horizontal part of the housing 1. As a preferred implementation manner, the battery may be a lithium ion battery. It should be noted that, the so-called lithium ion battery is a general term of rechargeable batteries based on lithium ion emergence-embedding reaction, and according to different anode materials, various systems may be formed, such as a "lithium manganese" battery and a "lithium iron" battery. In this implementation manner, the lithium ion battery is a lithium ion battery whose rated voltage is 3.6 V (volts). Definitely, the battery may also be of a battery type well-known by persons skilled in the art, such as a nickel-cadmium battery and a nickel-metal hydride battery.

The transmission mechanism 3 includes, from back to front (the right side of the drawing is used as the back), a planetary gear retarding mechanism 31 and a small gear mechanism 32 that are driven by the motor 2, where the small gear mechanism 32 is connected to the output shaft 4 and drives the output shaft 4 to rotate.

In the preferred implementation manner of the present invention, the motor 2 is an electric motor, and the electric motor has an electric motor shaft 21 extending forwards from an electric motor housing. The electric motor is fixed in the housing 1, a gearbox 22 is fixed in the housing 1 and located at the front portion of the electric motor, and the gearbox 22 is used to receive the planetary gear retarding mechanism 31. The small gear mechanism 32 includes a first gear 301 that is connected to the planetary gear retarding mechanism 31 with a gear shaft 308 and can transmit torque, a third gear 303 connected to the output shaft 4, and a second gear 302 engaged with the first gear 301 and the third gear 303 simultaneously, such configuration enables a rotation axis of the output shaft 4 be parallel to a rotation axis of the electric motor 2. Definitely, if required, the rotation axis of the output shaft 4 may also be disposed to form an angle with the rotation axis of the electric motor 2. The gear shaft 308 and the first gear 301 may be disposed integrally, the second gear 302 transmits rotation of the first gear 301 to the third gear 303, and two ends of each gear is supported by a shaft sleeve. A shaft sleeve rear supporting the small gear mechanism 32 is fixed on the gearbox 22, and a front shaft sleeve is fixed on the front housing 13.

Definitely, two gears may be disposed as required, one gear is connected to the planetary gear retarding mechanism 31, and the other is connected to the output shaft 4. In addition, the transmission mechanism 3 is not limited to the above form, the transmission mechanism 3 may only include the planetary gear retarding mechanism 31, or only include the small gear mechanism 32, or include another rotation movement transmission mechanism such as a ratchet mechanism and a turbine mechanism. The planetary gear retarding mechanism 31 has a triple retarding system, the motor shaft 21 extends to be engaged with the planetary gear retarding mechanism 31, the planetary gear retarding mechanism 31 transmits the rotation movement to the small gear mechanism 32, and the small gear mechanism 32 drives the output shaft 4 to rotate. In this way, when the electric motor 2 runs, the movement is output finally by the output shaft 4 through the planetary gear retarding mechanism 31 and the small gear mechanism 32. In addition, the retarding mechanism is formed by a triple planetary retarding system and a double parallel shaft retarding system to obtain required output rotation speed, and in another implementation manner, according to a required rotation speed, the retarding mechanism may only include the double parallel shaft retarding system or another retarding system.

The output shaft 4 has an output end used to connect the tool bit 9, and a second end located at the other end of the output end; the output end is the front end of the output shaft, and the second end is the rear end of the output shaft. The front end of the output shaft 4 is provided with an axially disposed accommodation hole 41, and the accommodation hole 41 is used to mount the tool bit 9. A cross section of a handle part of a common standard tool bit is hexagonal, that is, the handle part is formed as a torque accepting part of the tool bit, and the accommodation hole 41 is configured as an hexagonal hole that matches with the torque accepting part of the tool bit, thereby implementing the torque transmission from the output shaft 4 to the tool bit 9. Definitely, the tool bit may be non-standard, that is, the cross section of the torque accepting part may be polygonal, and correspondingly, the accommodation hole is configured as polygonal that matches with the torque accepting part. In addition, a magnet may be fixedly disposed in the accommodation hole 41 to hold the tool bit and prevent the tool bit from dropping when the output shaft 4 faces downwards. The front end of the output shaft 4 is supported on the front housing 13 with a shaft sleeve 40, the shaft sleeve 40 provides radial support for the output shaft 4, and definitely, the radial support for the output shaft 4 may also be provided through bearing. The output shaft 4 is at least partially constructed as a torque receiving part, the torque receiving part is arranged as a hexagonal shaft, that is, the cross section of the torque receiving part is hexagonal, and correspondingly, the third gear 323 is provided with an hexagonal hole, the third gear 323 is an external gearing cylindrical gear and transmits the torque to the output shaft 4 through the hexagonal hole; therefore, the hexagonal hole is constructed as a torque transmission part of the third gear 323, the output shaft can move in the hexagonal hole, and the torque receiving part of the output shaft is engaged to the torque transmission part of the third gear 323, in this way, regardless how the output shaft moves axially, the torque transmission can be implemented, that is, the third gear 323 transmits the rotation power to the output shaft 4, and then the output shaft 4 drives the tool bit 9 to rotate.

A support block 42 is axially fixed at a rear shaft of the output shaft 4, the support block 42 is in a hollowed square shape, the output shaft 4 has a support end 43 connected to the support block 42, the support end 43 is configured into a cylindrical shape, one side of the support block 42 is provided with a round hole or a U-shaped hole, the support end 43 penetrates through the round hole or the U-shaped hole to be rotatably supported on the support block 42, and the support end 43 may be provided with an annular groove to assemble a check ring, or a shaft shoulder is disposed to be clamped on the support block 42, so as to limit the axial movement of the output shaft 4. The diameter of the support end 43 is preferably less than the diameter of a circumcircle of the hexagon of the output shaft 4, so that the volume of the support block 42 is reduced to implement a more compact overall structure of the tool. The other side edge of the support block 42 opposite to the round hole or the U-shaped hole abuts against the end portion of the support end 43, where the end portion of the support end 43 is configured into a conical shape or a spherical shape, in this way, contact between the output shaft 4 and the support block 42 is point contact, and because the electric screw driver needs to axially press the tool bit 9 against the work piece during operation, the tool bit 9 is subjected to a reversed axial force, and the axial force is transmitted to the output shaft 4, so that a large force friction is generated between the output shaft 4 and the support block 42, the point contact manner may reduce the friction and increase the service life of the output shaft 4. In addition, the output shaft 4 and the support block 42 may both be made of metal, so as to reduce the degree of wear between the output shaft 4 and the support block 42. Moreover, the support block 42 may be connected by multiple hollowed square shapes, so as to enhance the strength. Disposing the support block 42 may further have other advantages, for example, the output shaft 4 is rotatably supported on the support block 42, and therefore, no bearing is used for support, thereby reducing the volume and cost of the tool.

In order that the electric screw driver can be operated in a small space, in a non-working state, that is, when the electric screw driver is not used to tighten up a screw, the output shaft 4 is configured to be movable axially. In a working state, axial movement of the output shaft in a first axis direction is restricted; the first axial direction refers to an axial direction from the output end to the second end.

The output shaft 4 at least has two working positions. The working position in the present invention refers to a position where the output shaft is located when the output shaft is loaded; that is, when the output shaft is in the working position, the output shaft can receive an external torque. Specifically, for a screw driver of this embodiment, when the output shaft is in the working position, the screw driver can be operated to tighten up a screw.

In this embodiment, the two working positions are respectively a first working position that is relatively proximal to the housing 1 axially and outputs rotation, and a second working position that is relatively distal to the housing 1 axially and outputs rotation. Because the torque receiving part of the output shaft and the torque transmission part of the third gear 323 are kept being engaged, regardless whether the output shaft 4 works in the first working position or the second working position, the third gear 323 can drive the output shaft 4 to rotate. The length of a commonly used tool bit is about one inch, preferably, a distance that the output shaft 4 can move and extend is greater than the length of a tool bit; in other words, the distance that the output shaft 4 can move and extend is greater than 25 mm. The longer distance that the output shaft 4 can move and extend is better; however, in order that the overall size of the electric screw driver is small to be portable, the distance that the output shaft 4 can move and extend is less than about the length of a 4-inch tool bit, in other words, the distance that the output shaft 4 can move and extend is less than 110 mm. Definitely, the output shaft 4 is not limited to the above two working positions, and during actual use, three or more working positions that can lock the axial movement of the output shaft 4 may be set as desired.

During operation, the electric screw driver needs to axially press the tool bit 9 against the screw or the work piece, and in this way, the tool bit 9 is subjected to a reversed axial force, thereby generating retrocession of the output shaft 4. The electric screw driver is provided with a restricting mechanism, the restricting mechanism includes a restricting stiffened plate 14 fixedly disposed on the housing 1, when the output shaft is in the first working position, the rear end of the support block 42 axially abuts against the restricting stiffened plate 14 to limit the movement of the output shaft in the first axial direction, the first axial direction being an axial direction from the output end to the second end; that is, the output shaft cannot move backward (in a direction toward the motor 2) correspondingly, to restrict the output shaft in the second working position from moving forward (in a direction away from the motor 2), the restricting mechanism further includes a stop portion 224 fixedly disposed on the gearbox 22, when the output shaft is in the second working position, the front end of the support block 42 axially abuts against the stop portion 224 so that the output shaft cannot move forward.

Figure 11:
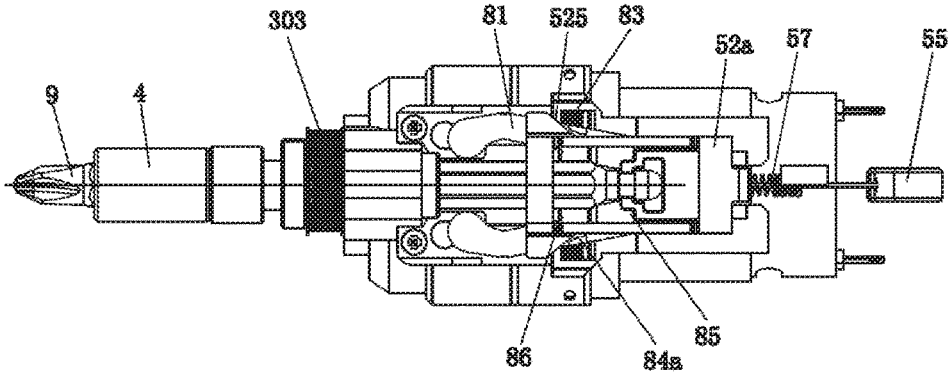
FIG. 11 is a top diagram of the power tool in FIG. 10 after a housing is removed.
Figure 12:
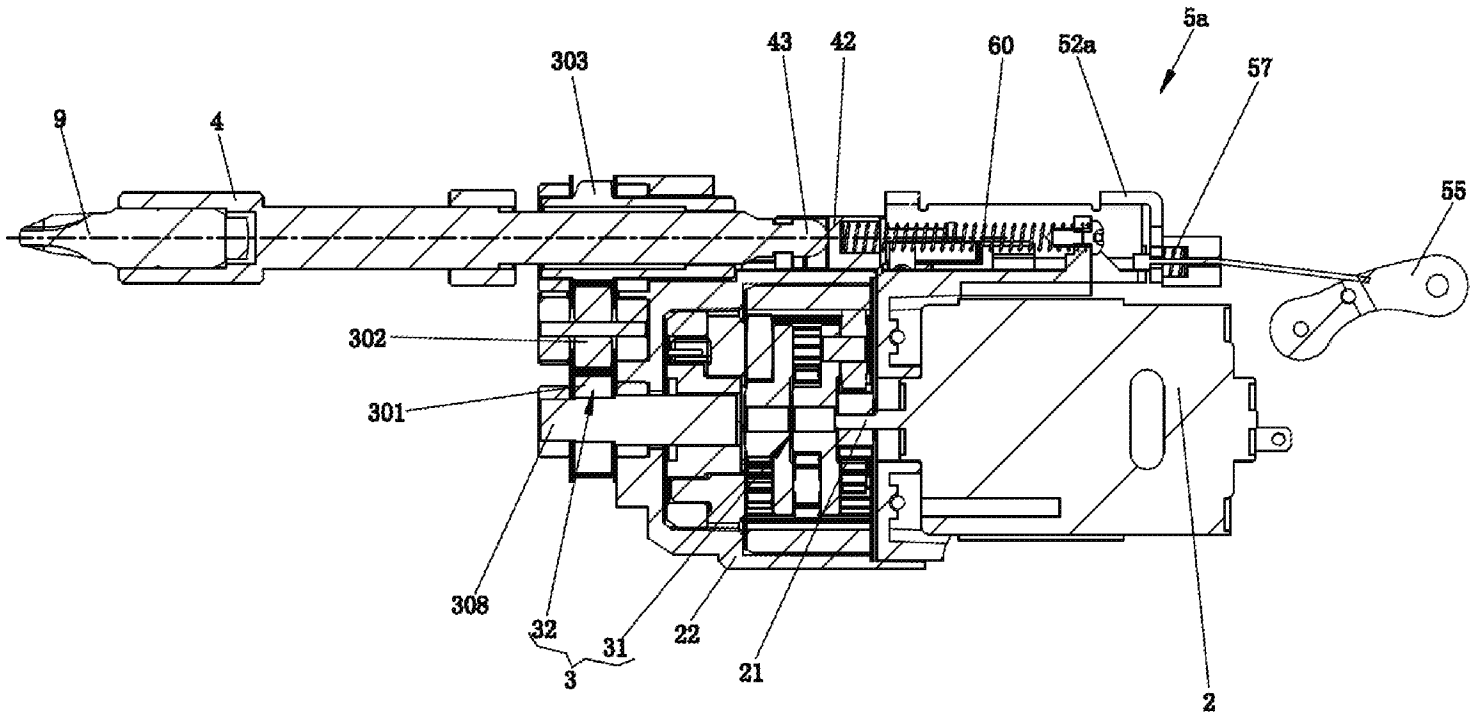
FIG. 12 is a schematic diagram of the power tool in FIG. 10 when the output shaft is in a second working position and a restricting member is in a releasing position.

Referring to FIG. 3 to FIG. 9, the restricting mechanism can limit or allow the movement of the output shaft in the second working position in the direction toward the motor 2, and the restricting mechanism further includes a restricting member 81 pivotable between the output shaft 4 and the housing 1, and a spring 83 biasing the restricting member 81. The restricting member 81 has a locking position that limits the output shaft 4 from moving and a releasing position that allows the output shaft 4 to move, and the spring 83 abuts against the restricting member 81 toward the locking position. The restricting member 81 is provided with a first locking claw 85 and a second locking claw 86 that are disposed axially along the output shaft and are spaced from each other, the first locking claw 85 is located at the end portion of one end of the restricting member 81, the second locking claw 86 protrudes from the middle portion of the restricting member 81 along a radial direction that can contact with the output shaft 4. When the output shaft 4 is in the first working position, the first locking claw 85 axially abuts against the front end of the support block 42, and the output shaft 4 is restricted from moving forward (in a direction away from the motor 2); when the output shaft 4 is located in the second working position, the second locking claw 86 is axially clamped to the rear end of the support block 42, and the output shaft 4 is restricted from moving backward. Therefore, by using a restricting member, backward restricting of the output shaft in the second working position and forward restricting of the output shaft in the first working position may be implemented, thereby saving parts and saving the space. The side part of the support block 42 has a large area, thereby being convenient for the restricting member 81 to abut against the support block 42 to restrict axial movement of the output shaft 4. The other end of the restricting member 81 is mounted to the housing 1 through a pin, an axis of the pin is perpendicular to an axis of the output shaft 4, and the restricting member 81 can rotate about the pin in a certain angle range. The spring 83 may be a torsional spring or a compressed spring, and is preferably a compressed spring in this embodiment, one end of the compressed spring abuts against the restricting member 81, and the other end abuts against the gearbox 22 or the housing 1, the elastic force of the compressed spring enables the restricting member 81 to keep in the locking position abutting against the support block 42 (as shown in FIG. 11 and FIG. 12). Preferably, two restricting members 81 are disposed and symmetrically distributed along the axis of the output shaft 4; therefore, force balance may be achieved, so that the axial restriction of the output shaft 4 is more reliable.

According to the structural principle of the restricting mechanism, persons skilled in the art can easily change configuration thereof, for example, the pivot of the restricting member may be configured to be parallel to the axial direction of the output shaft, or the restricting member may be configured to move linearly, or the like. The axial restriction of the restricting member on the output shaft may also be restricting the output shaft from moving backward when the output shaft 4 is in the second working position, and it is unnecessary to restrict the output shaft from moving forward when the output shaft 4 is in the first working position, this is because when the electric screw driver works, the screw driver abuts against the work piece, and when the output shaft 4 is in the first working position, the support block 42 axially abuts against the restricting stiffened plate 14, and the existence of the friction forces between the support block 42 and the housing, the output shaft 4 and the third gear 323 enables that the output shaft 4 will not move toward the second working position under the friction even the output shaft of the electric screw driver faces downward; therefore, the working and security of the electric screw driver will not be affected.

The restricting mechanism further includes an operation mechanism 5 connected to the housing 1, the operation mechanism 5 includes a sliding block 51 disposed outside the housing 1 and an unlocking block 52 disposed in the housing and fixedly connected to the sliding block 51, two sides of the housing 1 are provided with chutes 16 extending axially, and connection members such as pins or screws penetrate through the chutes 16 to connect the sliding block 51 to the unlocking block 52. By such configuration, dust and other things may be prevented from falling into the housing 1, and in order to further enhance the sealing effect, a flexible sealing strip that does not affect rotating of the pin may be connected on the chute 16. Definitely, the sliding block 51 and the unlocking block 52 may also be configured integrally, and a foldable sealing device may be disposed between the sliding block 51 and the housing 1 for dust proofing. The unlocking block 52 has a hollowed accommodation portion 521, the support block 42 is partially located in the accommodation portion 521, and therefore, the internal structure of the electric screw driver is compact, and the overall tool is small. The accommodation portion 521 of the unlocking block 52 is provided with clamping slots 522 symmetrically along the axial direction on sidewalls, the corresponding support block 42 is provided with legs 422 symmetrically along the axial direction, the leg 422*s* are clamped in the clamping slots 522 and can slide in the clamping slots 522 in a certain distance, and therefore, the unlocking block 52 and the support block 42 are in slide connection, that is, the two may move relatively, and may also move together. Front and rear sides of the unlocking block 52 along the axial direction are respectively provided with a first unlocking portion 523 and a second unlocking portion 524, the first unlocking portion 523 and the second unlocking portion 524 are configured into an inclined surface or a cambered surface, and correspondingly, the restricting member 81 has an abutting part 84 protruding therefrom, and the abutting part 84 is configured as an inclined surface or a cambered surface that can abut against the first unlocking portion 523 and the second unlocking portion 524, in this way, by means of axial movement of the unlocking block 52, the first unlocking portion 523 or the second unlocking portion 524 may drive the restricting member 81 through the abutting part 84 to move toward a direction away from the support block 42, a distance of relative sliding between the unlocking block 52 and the support block 42 needs to meet a condition that the unlocking block 52 moves to enable the restricting member 81 be separated from the support block 42; in other words, the unlocking block 52 moves by a distance S so that the restricting member 81 is separated from the support block 42, the distance of relative sliding between the unlocking block 52 and the support block 42 needs to be greater than or equal to S, then, the unlocking block 52 continuously moving axially can drive the support block 42 to move together. By means of the axial movement of the sliding block 51, the locking of the restricting member 81 on the axial movement of the output shaft 4 is released, and also, the axial movement of the output shaft 4 is output, so that the operation is convenient and quick.

The process of quick switch of a working state of an output shaft in a first preferred implementation manner of an electric screw driver according to the present invention is described in detail.

Figure 6:
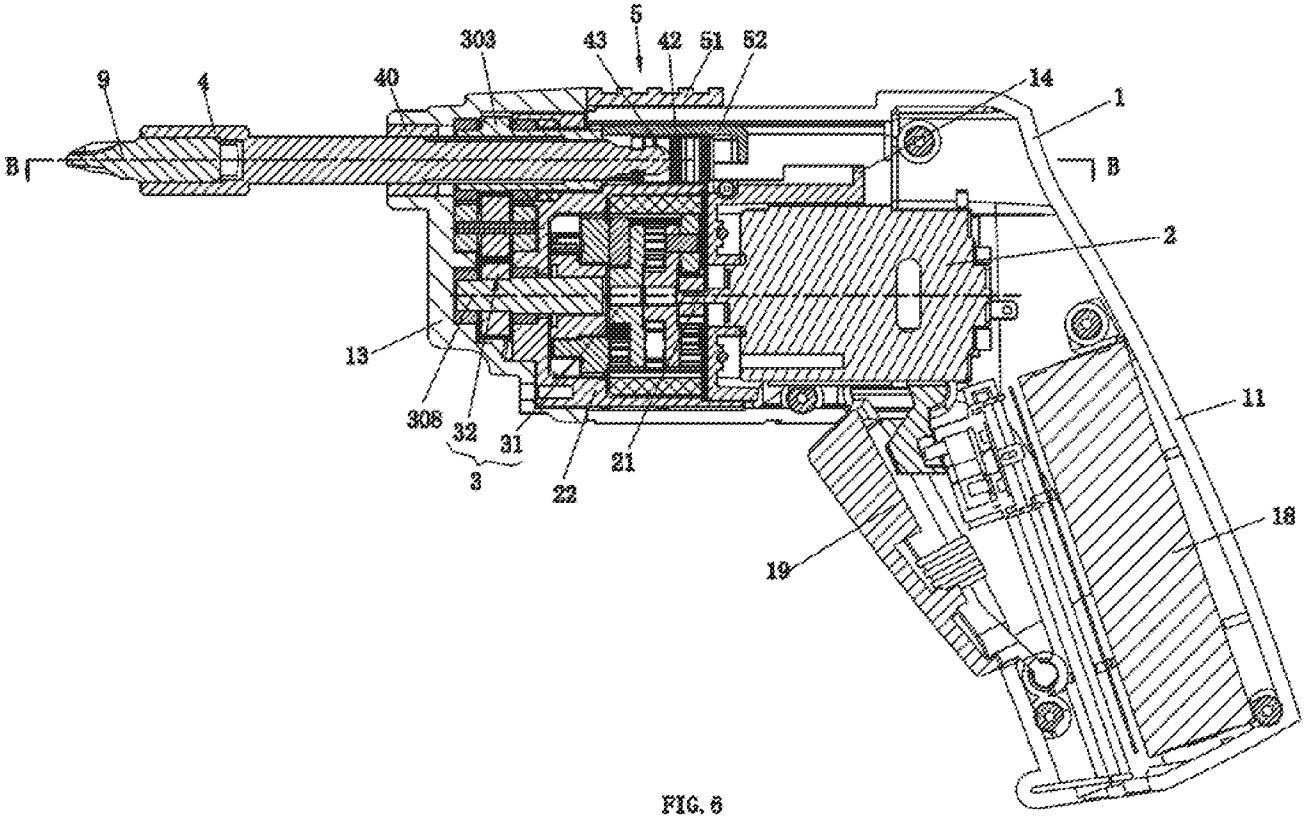
FIG. 6 is a sectional diagram of the output shaft of the power tool in FIG. 1 in a second working position.
Figure 7:
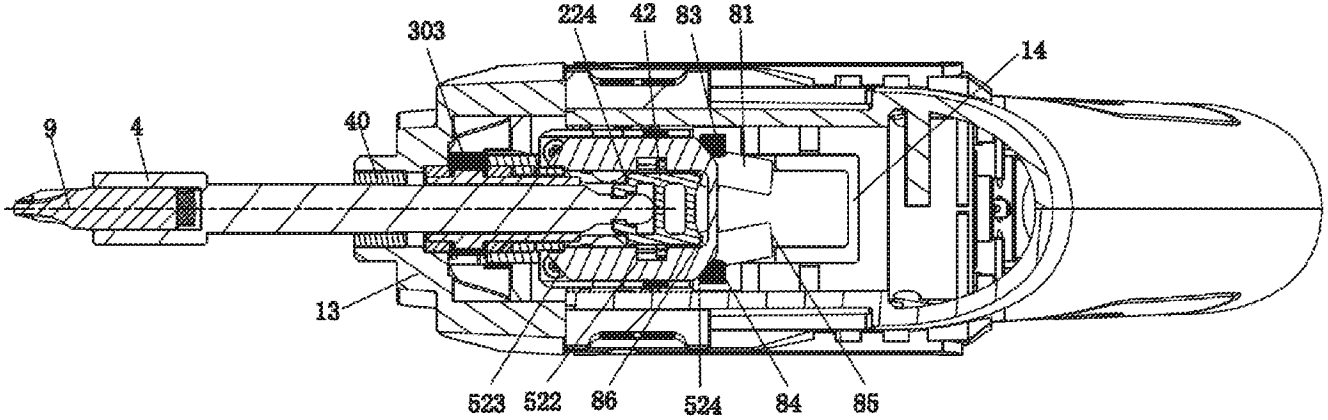
FIG. 7 is a schematic sectional diagram of the power tool in FIG. 6 taken along a line B-B.
Figure 8:
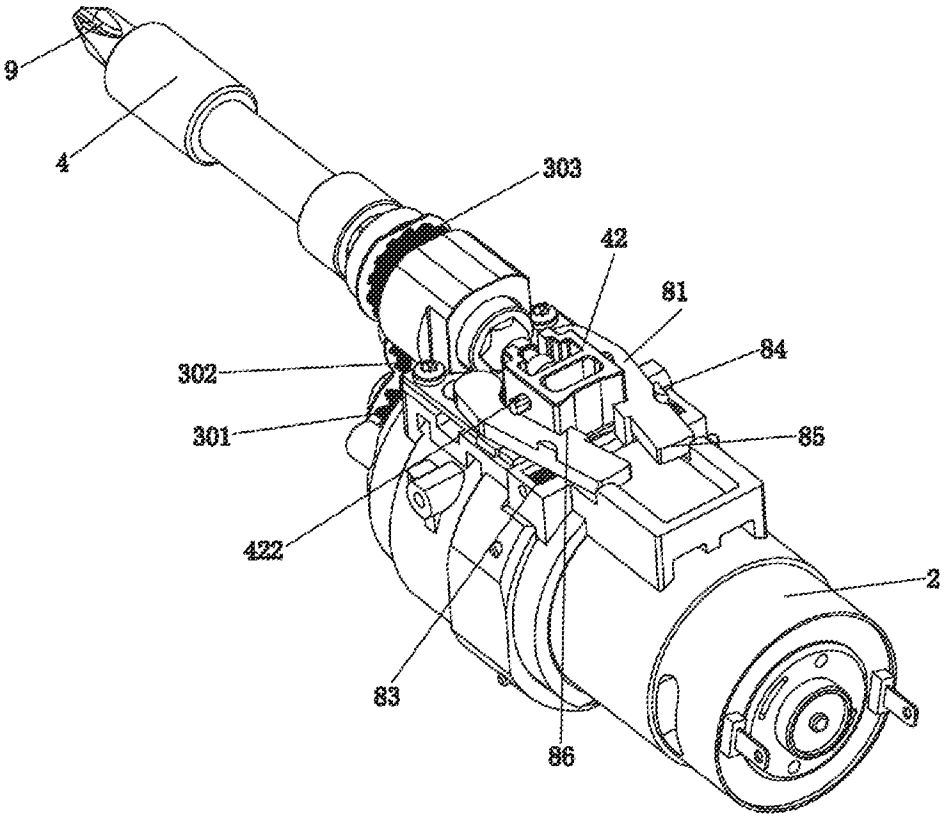
FIG. 8 is a three-dimensional diagram of the power tool in FIG. 6 after the housing is removed.

Referring to FIG. 1 to FIG. 4, the output shaft 4 of the electric screw driver is in a first working position proximal to the housing 1, and in this case, the work of tightening up a screw may be conducted by pressing the button switch 7. When it is needed to insert the output shaft 4 into a small space for operation, the sliding block 51 is operated to move forward, the sliding block 51 drives the unlocking block 52 to move forward together, the first unlocking portion 523 of the unlocking block 52 abuts against the abutting part 84 of the restricting member 81, and along with the movement of the unlocking block 52, the abutting part 84 drives the restricting member 81 to rotate about the pin thereof along the inclined surface of the first unlocking portion 523, until the first locking claw 85 of the restricting member 81 is separated from the support block 42, the locking of the restricting member 81 on the output shaft 4 is released, and at the same time, and the unlocking block 52 also moves from a position in which the leg 422 of the support block 42 is located at the front end of the clamping slot 522 to a position in which the leg 422 is located at the rear end of the clamping slot 522, for example, the position shown in FIG. 5. The sliding block 51 is moved forward continuously, the unlocking block 52 can drive the support block 42 to move forward together, until the sliding block 51 abuts against the front housing 13, and the restricting member 81 is restored, under the effect of the spring 83, to a position in which the second locking claw 86 is axially clamped to the rear end of the support block 42, as shown in FIG. 6 to FIG. 8, the output shaft 4 is restricted by the restricting member 81 from moving backward, and in this case, the output shaft 4 of the electric screw driver is in a second working position distal to the housing 1, the output shaft 4 can be inserted into the small space, and the work of tightening up the screw can be conducted by pressing the button switch 7.

Figure 9:
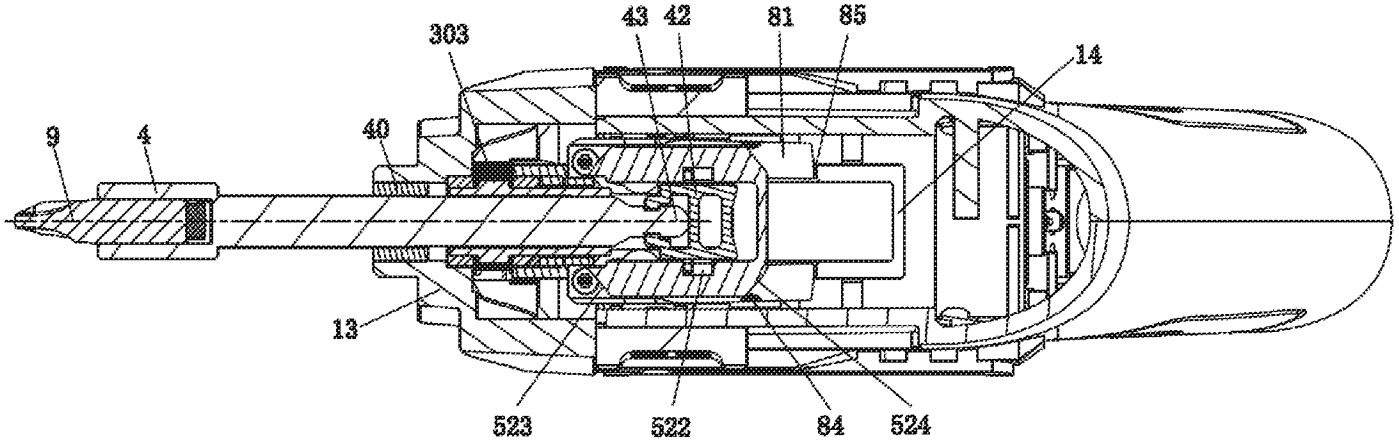
FIG. 9 is a three-dimensional diagram of the output shaft in FIG. 7 after locking of axial movement is released.

If it is needed to restore the output shaft 4 to the first working position, the sliding block 51 is operated to move backward, the sliding block 51 drives the unlocking block 52 to move backward together, the second unlocking portion 524 of the unlocking block 52 abuts against the abutting part 84 of the restricting member 81, and along with the movement of the unlocking block 52, the abutting part 84 drives the restricting member 81 to rotate about the pin thereof along the inclined surface of the second unlocking portion 524, until the second locking claw 86 of the restricting member 81 is separated from the support block 42, and the locking of the restricting member 81 on the output shaft 4 is released, for example, the position shown in FIG. 9; at the same time, the unlocking block 52 also moves from the position in which the leg 422 of the support block 42 is located at the rear end of the clamping slot 522 to the position in which the leg 422 is located at the front end of the clamping slot 522, the sliding block 51 is moved backward continuously, the unlocking block 52 can drive the support block 42 to move backward together, until the sliding block 51 axially abuts against the housing 1, and the restricting member 81 is restored, under the effect of the spring 83, to the position in which the first locking claw 85 axially abuts against the front end of the support block 42, and at the same time, the output shaft 4 is also restored to the first working position proximal to the housing 1, that is, to the position shown in FIG. 1 to FIG. 4. The above operations are repeated, and the output shaft 4 can move between the first working position near the housing 1 and the second working position distal to the housing 1.

FIG. 10 to FIG. 15 show a second preferred implementation manner of the present invention, and in the second preferred implementation manner, structures and functions of members having reference numerals the same as those in the first preferred implementation manner are the same as those in the first preferred implementation manners, and are not repeated herein.

In the implementation manner, an operating mechanism **5*a* includes an operating button 55 disposed outside the housing 1 and an unlocking block 52*a* disposed in the housing 1 and driven by the operating button 55. The tail portion of the housing 1 is provided with an open slot 15, one end of the operating button 55 is pivoted to the housing 1, and the other end is exposed from the open slot 15 for an operator to operate. One end of a flexible rope 56 is connected to the middle part of the operating button 55, and the other end of the flexible rope 56 is connected to the rear end of the unlocking block 52*a*. When the operating button 55 rotates about a pivot thereof, it may drive the unlocking block 52*a* through the flexible rope 56 to rotate axially. The unlocking block 52 has a hollow accommodation portion 521*a*, the support block 42 is at least partially located in the accommodation portion 521*a*, and therefore, the internal structure of the electric screw driver is compact, and the overall tool is small. Two sides of the unlocking block 52*a* are provided with unlocking portions 525 disposed axially in a symmetric manner, the unlocking portions 525 are configured as inclined surfaces or cambered surfaces, and correspondingly, the restricting member 81 has an abutting part 84*a* protruding therefrom, the abutting part 84*a* is configured to abut against the inclined surface or cambered surface of the unlocking portion 525; in this way, by means of the axial movement of the unlocking block 52*a*, the abutting part 84*a* drives the restricting member 81 toward a direction away from the support block 42 along the inclined surface of the unlocking portion 52***a*.

A reset spring 57 is connected between the unlocking block 52*a* and the housing 1, the reset spring 57 biases the unlocking block 52*a* in a direction being reversed to the movement of the unlocking block 52*a* driven by the operating button 55, and in this way, when the restriction on the axial movement of the output shaft 4 is released, unlock may be conducted only by pressing the operating button 55. When the output shaft 4 is adjusted to the second working position, the operating button 55 is released, and the unlocking block 52*a* is restored to the initial position under the effect of the reset spring 57.

Further, an ejecting mechanism may be disposed between the housing 1 and the output shaft 4, and when the output shaft 4 is located in the first working position, the elastic force of the ejecting mechanism is stored; when the output shaft 4 is located in the second working position, the elastic force of the ejecting mechanism is released. Specifically, the ejecting mechanism is preferably a compressed spring 60, one end of the compressed spring 60 abuts against the support block 42, and the other end thereof abuts against the housing 1. When the output shaft 4 is located in the first working position, the compressed spring 60 is compressed, and after the restriction locking of the output shaft 4 is unlocked, the elastic force of the compressed spring 60 is released to press the output shaft 4 to move to the second working position. In this way, as long as the locking on the axial movement of the output shaft 4 is released, the output shaft 4 can be ejected automatically by the compressed spring 60. The ejecting mechanism may also be applied in the first implementation manner, and specific configuration can be easily derived by persons skilled in the art and will not be repeated herein.

The process of quick switch of a working state of the output shaft 4 in the second preferred implementation manner of an electric screw driver according to the present invention is described in detail.

Figure 10:
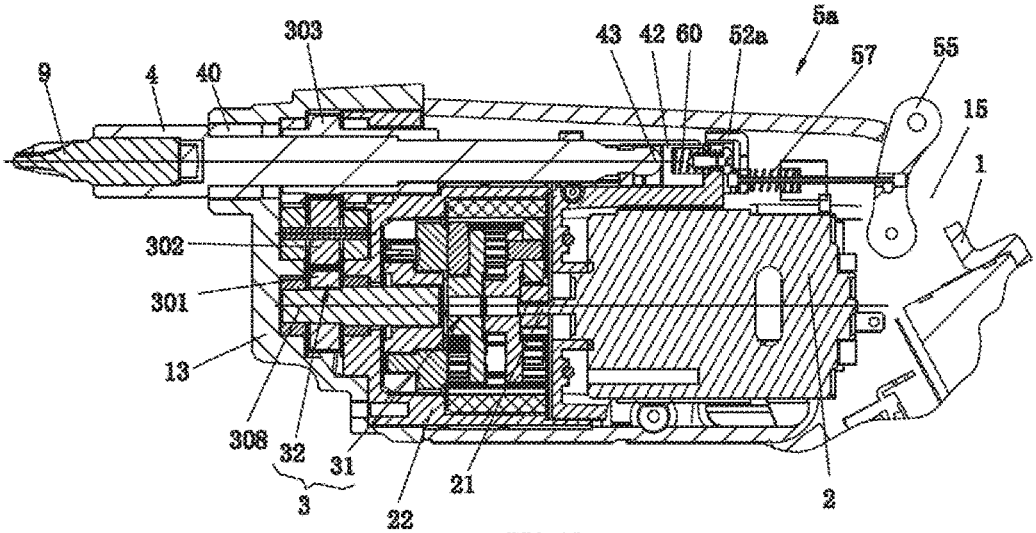
FIG. 10 is a sectional diagram of a power tool according to a second preferred implementation manner of the present invention, and in this case, an output shaft is located in a first working position.
Figure 14:
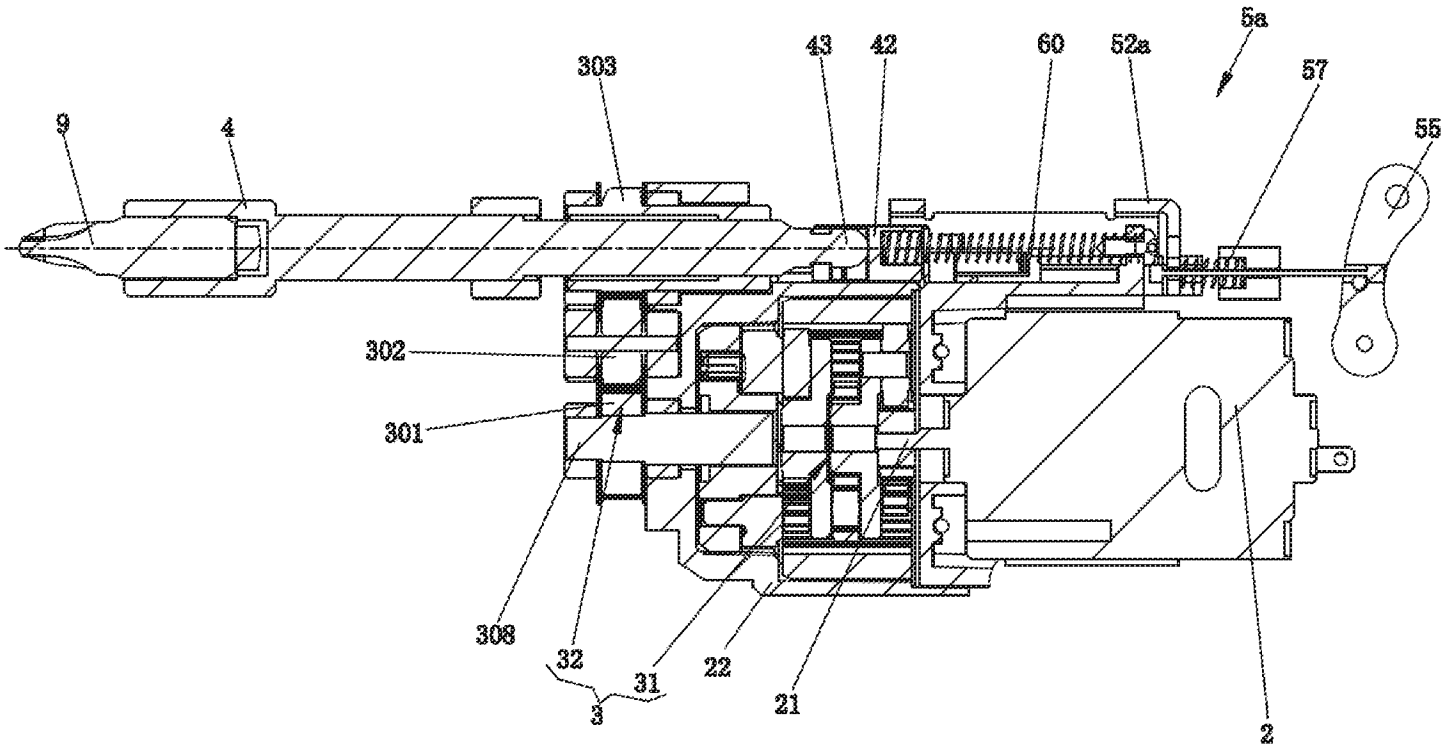
FIG. 14 is a schematic diagram of the power tool in FIG. 10 when the output shaft is in the second working position and the restricting member is in a locking position.
Figure 15:
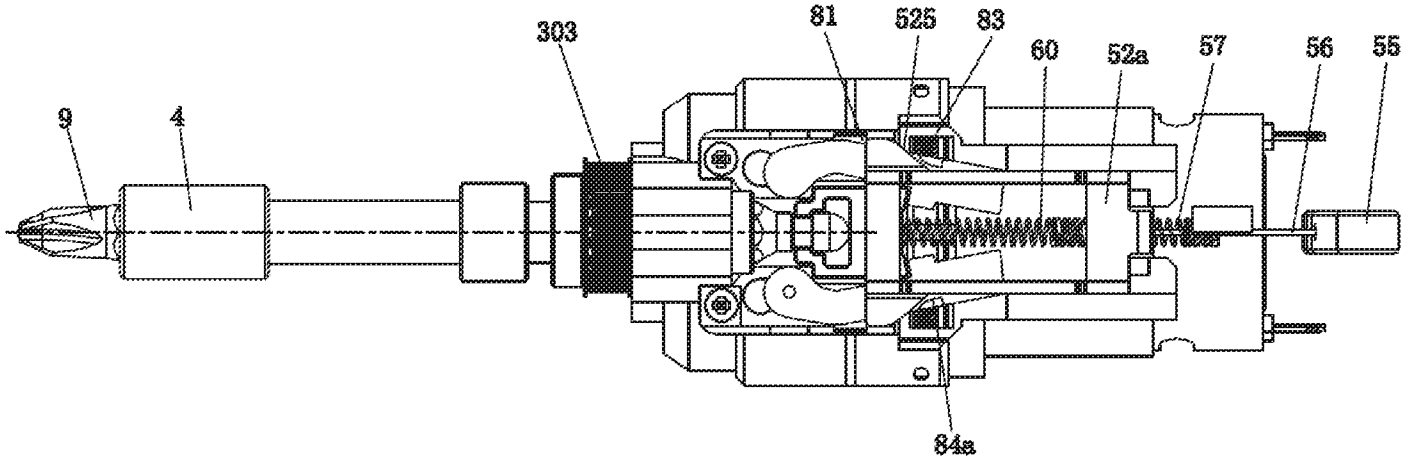
FIG. 15 is a top diagram of the power tool in FIG. 14.
Figure 16:
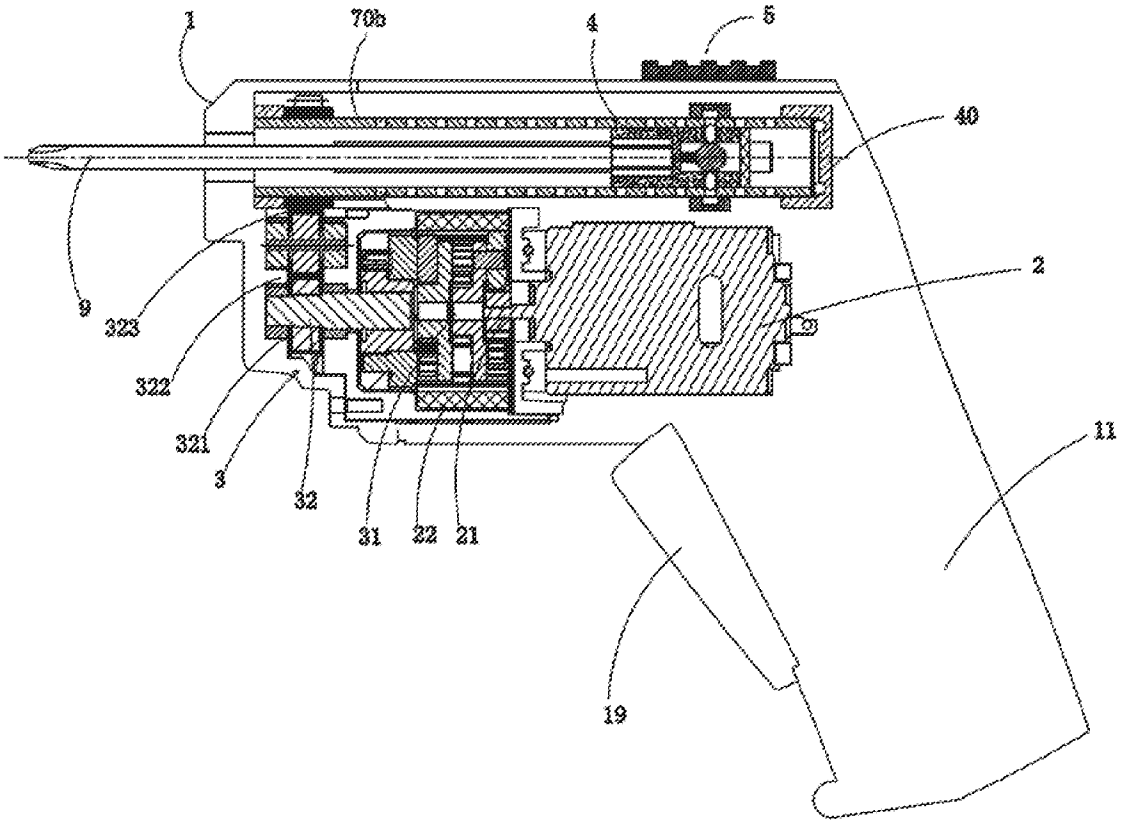
FIG. 16 is a schematic sectional diagram of a power tool according to a third preferred implementation manner of the present invention.

Referring to FIG. 10 and FIG. 11, the output shaft is in the first working position proximal to the housing, and in this case, the work of tightening up a screw may be conducted by pressing the button switch 7. When it is needed to insert the output shaft 4 into a small space for operation, the operating button 55 is pressed so that it rotates about a pivot thereof, the operating button 55 drives, through the flexible rope 56, the unlocking block 52*a* to move backward, the unlocking portion 525 of the unlocking block 52*a* abuts against the abutting part 84*a* of the restricting member 81, and along with the movement of the unlocking block 52*a*, the abutting part 84*a* drives the restricting member 81 to rotate about a pin thereof along the inclined surface of the unlocking portion 525, until the first locking claw 85 of the restricting member 81 is separated from the support block 42, the locking of the restricting member 81 on the output shaft 4 is released, and at the same time, the elastic force of the compressed spring 60 is released to drive the output shaft 4 to move to the second working position distal to the housing 1, for example, the position shown in FIG. 12 and FIG. 13. The operating button 55 is released, the unlocking block 52*a* moves forward under the effect of the reset spring 57, and in this case, the unlocking block 52*a* also drives, through the flexible rope 56, the operating button 55 to restore to the initial position; in this way, the unlocking portion 525 of the unlocking block 52*a* is disengaged from the abutting part 84*a* of the restricting member 81, the restricting member 81 is restored, under the effect of the compressed spring 83, to the position in which the second locking claw 86 is axially clamped to the rear end of the support block 42, as shown in FIG. 14 and FIG. 15. The output shaft 4 is restricted by the restricting member 81 from moving backward, and in this case, the output shaft 4 can be inserted into the small space, and the work of tightening up the screw may be conducted by pressing the button switch 7.

Figure 13:
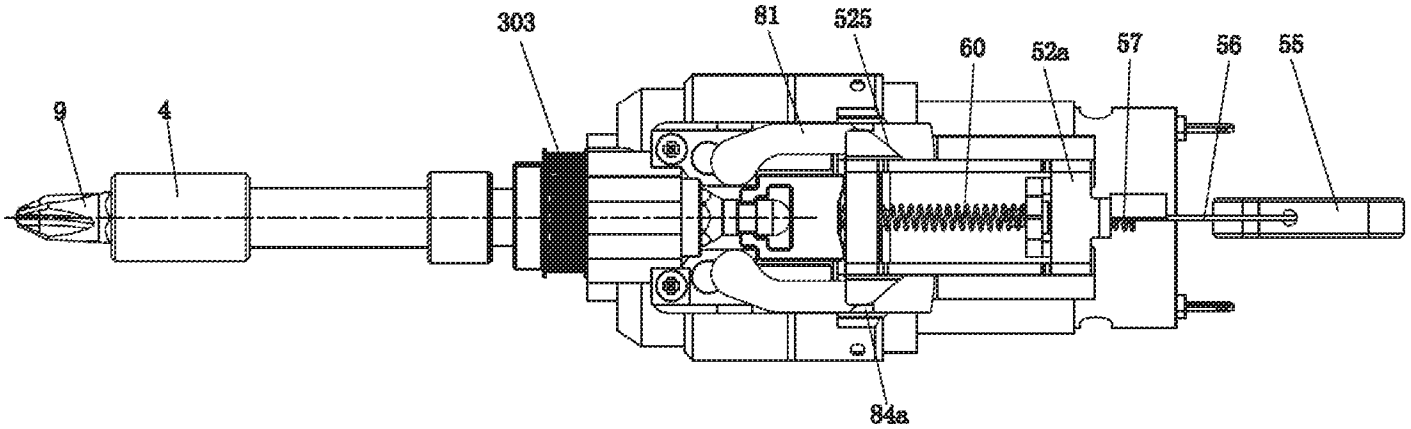
FIG. 13 is a top diagram of the power tool in FIG. 12.

If it needs to restore the output shaft 4 to the first working position, the operating button 55 is pressed, the operating button 55 drives, through the flexible rope 56, the unlocking block 52*a* to move backward, the unlocking portion 525 of the unlocking block 52*a* abuts against the abutting part 84*a* of the restricting member 81, and along with the movement of the unlocking block 52*a*, the abutting part 84*a* drives the restricting member 81 to rotate about a pin thereof along the inclined surface of the unlocking portion 525, until the second locking claw 86 of the restricting member 81 is separated from the support block 42, and the locking of the restricting member 81 on the output shaft 4 is released, which is the same as the state shown in FIG. 12 and FIG. 13. In this case, the output shaft 4 is pressed against the work piece or the wall, or the output shaft 4 is pressed manually so that it overcomes the elastic force of the compressed spring 60 and move backward, until the support block 42 abuts against the restricting stiffened plate 14 of the housing 1, the operating button 55 is then released, the unlocking block 52*a* moves forward under the effect of the reset spring 57, and at the same time, the unlocking block 52*a* also drives, through the flexible rope 56, the operating button 55 to restore the initial position. In this way, the unlocking portion 525 of the unlocking block 52*a* is disengaged from the abutting part 84*a* of the restricting member 84, the restricting member 81 restores, under the effect of the spring 83, to the position in which the first locking claw 85 axially abuts against the front end of the support block 42, and in this case, the output shaft 4 also restores to the first working position proximal to the housing 1, that is, the position shown in FIG. 10 and FIG. 11. By repeating the above operations, the output shaft 4 can move between the first working position proximal to the housing 1 and the second working position distal to the housing.

In the second implementation manner, it may also be configured that the output shaft 4 is moved from the first working position to the second working position by a manual operation, and is moved from the second working position to the first working position by elastic automatic reset, the specific configuration manner may be easily changed by persons skilled in the art according to the above implementation manner, and is not repeated herein.

FIG. 16 to FIG. 25 show a third preferred implementation manner of the implementation manner. In the third implementation manner, structures and functions of members having reference numerals the same as those in the first preferred implementation manner are the same as those in the first preferred implementation manners, and are not repeated herein.

The power tool further includes a reference member mounted on the housing 1, and the output shaft 4 may move axially relative to the reference member.

Specifically, the reference member is a sleeve 70*b*.

The sleeve 70*b* has an internal cavity for accommodating the output shaft 4 and the tool bit 9, and the output shaft 4 may move axially in the internal cavity of the sleeve 70*b*. Definitely, the sleeve may partially accommodate the output shaft.

A torque accepting part may be formed in the internal cavity of the sleeve 70*b*, the outline of the output shaft 4 has a torque receiving part for receiving the torque from the sleeve 70*b*, and the torque accepting part of the sleeve 70*b* matches with the torque receiving part of the output shaft 4, thereby implementing the sleeve 70*b* transmitting the torque to the output shaft 4, and the output shaft 4 rotates under the driving of the sleeve 70*b*. The torque accepting part of the sleeve 70*b* covers all working positions of the output shaft 4, that is, the output shaft 4 can accept the torque from the sleeve 70*b* in all working positions. Definitely, the internal cavity of the sleeve 70*b* may not be provided with the torque accepting part, but the torque is transmitted to the output shaft 4 by the restricting mechanism.

One end of the sleeve 70*b* near the handle 11 is supported on the housing 1 through a shaft sleeve 40, the shaft sleeve 40 provides radial support for the sleeve 70*b*, and definitely, the radial support for the sleeve 70*b* may also be implemented through bearing.

The structure and function of the transmission mechanism 3 are basically the same as those in the first preferred implementation manner, and a difference lies in that, the transmission mechanism drives the sleeve 70*b* to rotate, and the sleeve 70*b* drives the output shaft 4 to rotate. That is, the small gear mechanism 32 is connected to the sleeve 70*b* and drives the sleeve 70*b* to rotate.

The sleeve 70*b* does not move axially. Definitely, if necessary, the third gear and the sleeve may be formed integrally, that is, gear teeth of the third gear are provided on the periphery of the sleeve 70*b*, the gear teeth are directly engaged with the second gear 302, so as to transmit the rotation of the first gear 301 to the sleeve 70*b* directly.

Definitely, the sleeve 70*b* may also move axially. When the sleeve moves axially, the periphery of the sleeve 70*b* is at least partially constructed into a torque receiving part, the torque receiving part is configured as a hexagonal shaft, that is, the cross section of the torque receiving part is hexagonal, and the corresponding third gear 303 is provided with a hexagonal hole, the third gear 303 is an external gearing cylindrical gear and transmits the torque to the sleeve 70*b* through the hexagonal hole; therefore, the hexagonal hole is constructed as a torque transmission part of the third gear 303, the sleeve 70*b* can move in the hexagonal hole, and the torque receiving part of the output shaft is engaged with the torque transmission part of the third gear 303, in this way, even when the sleeve 70*b* has a plurality of working positions in the axial direction, torque transmission may be implemented when the sleeve 70*b* moves axially, that is, the third gear 303 transmits the rotation power to the sleeve 70*b*.

The output shaft 4 is configured as movable axially along the sleeve 70*b*.

The electric screw driver is provided with a restricting mechanism, and the restricting mechanism can selectively restrict and allow the axial movement of the output shaft 4. Therefore, the output shaft 4 can be locked axially, or axial locking of the output shaft may be released. When the restricting mechanism is in a lock state, the output shaft 4 is locked axially, that is, axial movement of the output shaft 4 is restricted; when the restricting mechanism is in an unlock state, axial locking of the output shaft 4 is released, that is, the axial movement of the output shaft 4 is allowed.

The output shaft 4 has working positions along the axial direction of the sleeve 70*b*. When the output shaft are in the working positions, the restricting mechanism may restrict or allow the axial movement of the output shaft 4, and the working position have different distances from the external of the housing 1, so that the length of the tool bit 9 extending out of the housing 1 is adjustable.

The working positions are non-successive, and the number of the working positions is limited, that is, a certain interval exists between the working positions. During actual use, three or more working positions that can lock the axial movement of the output shaft 4 may be set as desired.

According to an actual working environment, the distance that the output shaft 4 can move and extend is preferably greater than 25 mm. The longer distance that the output shaft 4 can move and extend is better; however, in order that the overall size of the electric screw driver is small to be portable, the distance that the output shaft 4 can move and extend is less than about the length of a 4-inch tool bit, in other words, the distance that the output shaft 4 can move and extend is less than 101 mm. According to an actual working environment, the length of the tool bit is preferably 25-101 mm.

In the implementation manner, the restricting mechanism may further drive the output shaft to move axially, that is, after the restricting mechanism allows the output shaft to move axially, the operator may further drive, through the restricting mechanism, the output shaft to move axially. In this way, when the operator operates, unlocking and moving can be implemented by only one hand, which greatly increases the comfort of the operator during the operation.

The output shaft 4 is connected to a locking member, and the locking member is relatively static with respect to the axial direction of the output shaft 4.

The restricting mechanism further includes a positioning part, a locking part, and a positioning member.

The positioning part is disposed on the sleeve 70*b*, the locking part is disposed on the locking member, the positioning member is movable radially, and the positioning member can axially lock the positioning part and the locking part or release the axial locking of the positioning part and the locking part.

The positioning member has a locking position and a releasing position.

When the positioning member is in the locking position, the positioning member axially locks the positioning part and the locking part, thereby implementing the axial locking of the sleeve and the output shaft. When the positioning member is in the releasing position, the positioning member releases the axial locking between the positioning part and the locking part, thereby implementing axial movement of the sleeve and the output shaft.

Referring to FIG. 17 to FIG. 23, the positioning part is a positioning hole 71*b* disposed on an inner wall of the sleeve 70*b*; the locking part is a lock hole 72*b* disposed on the locking member; and the positioning member 73*b* is located in the lock hole 72*b* and can be partially embedded in the positioning hole 71*b*.

Specifically, the positioning hole 71*b* is one-to-one corresponding to the working positions of the output shaft 4. Several positioning holes form a positioning hole column, and the positioning hole column is distributed linearly in a direction parallel to the axial direction of the sleeve. On the sleeve 70*b*, there are two positioning hole columns disposed correspondingly up and down. Definitely, there may be one positioning hole column.

The locking member is a locking arm 49*b* disposed on the output shaft 4, and the locking arm 49*b* is disposed at one end of the output shaft 4 away from the tool bit 9. Definitely, the locking arm 49*b* and the output shaft may also be formed separately, and the locking arm is fixedly connected to one of the output shaft to which the tool bit is mounted. The locking arm and the output shaft may also be formed integrally.

Figure 22:
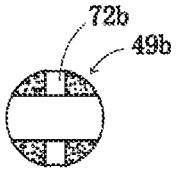
FIG. 22 is a schematic sectional diagram of a locking arm in FIG. 17 taken along the line D-D

Referring to FIG. 22, FIG. 22 is a schematic sectional diagram of a locking arm. The lock hole 72*b* is disposed on the locking arm 49*b*, the lock hole 72*b* matches with the positioning hole 71*b*, the lock hole 72*b* is a through hole penetrating through the locking arm 49*b*, and the positioning member 73*b* passes through the lock hole 72*b* and is movable in the lock hole 72*b*.

The restricting mechanism further includes a positioning control assembly, and the positioning control assembly controls the positioning member to move between the locking position and the releasing position.

Preferably, the positioning member moves radially.

Under the effect of the positioning control assembly, the positioning member 73*b* disposed on the output shaft may be embedded into the positioning hole 71*b* or separated from the positioning hole 71*b*. When the positioning member 73*b* is embedded into the positioning hole 71*b*, the output shaft 4 and the sleeve 70*b* are locked axially, that is, the output shaft 4 cannot move axially in the sleeve 70*b*; when the positioning member 73*b* is separated from the positioning hole 71*b*, the output shaft 4 and the sleeve 70*b* are unlocked axially, and therefore, the output shaft 4 can move axially in the sleeve 70*b*.

When the positioning member 73*b* protrudes from the lock hole 72*b* and is embedded into the positioning hole 71*b*, a part of the positioning member 73*b* is located in the lock hole 72*b*, and the other part is located in the positioning hole 71*b*, so that the locking arm 49*b* cannot move axially with respect to the sleeve 70*b*; therefore, the output shaft 4 cannot move axially with respect to the sleeve 70*b*. When the positioning member 73*b* is separated from the positioning hole 71*b* and retracts into the lock hole 72*b*, locking of the axial movement between the locking arm 49*b* and the sleeve 70*b* is released; therefore, the output shaft 4 and the sleeve 70*b* can move axially.

Figure 17:
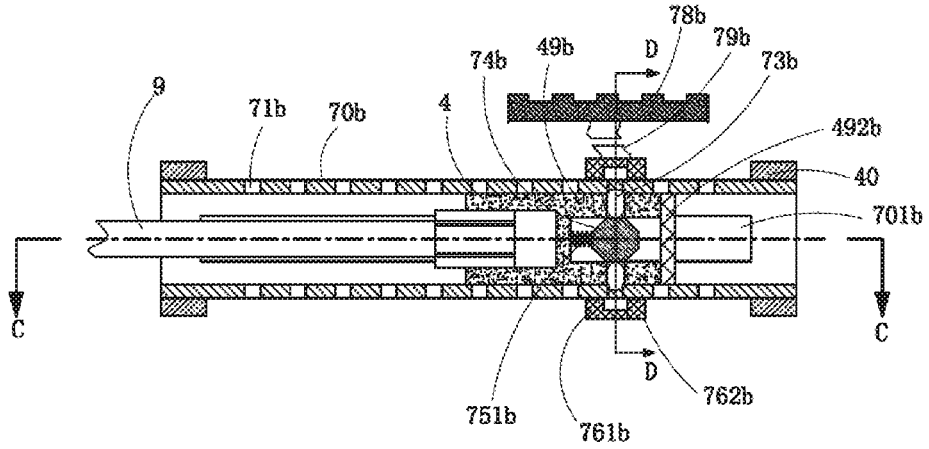
FIG. 17 is a schematic sectional diagram of a sleeve and related parts thereof of the power tool in FIG. 16.
Figure 18:
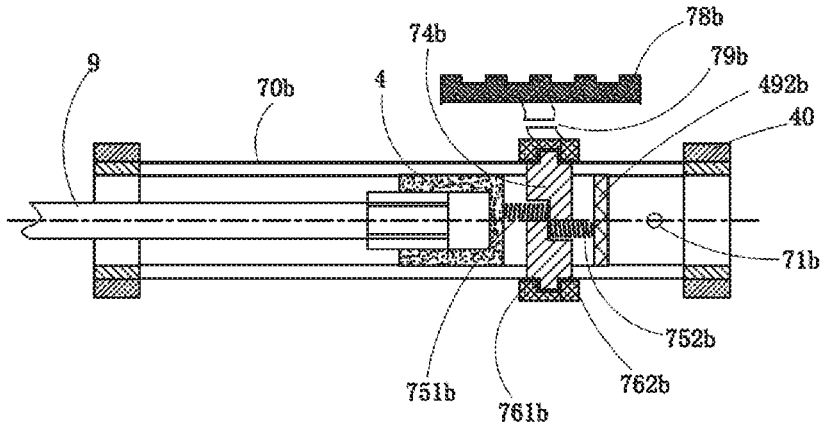
FIG. 18 is a schematic sectional diagram of the power tool in FIG. 17 taken along a line C-C.
Figure 23:
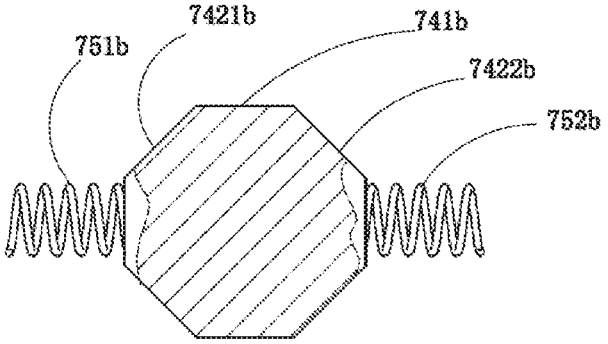
FIG. 23 is a schematic enlarged semi-sectional diagram of a pushing member and a reset member in FIG. 17.

Referring to FIG. 17 to FIG. 18 and FIG. 23, the positioning control assembly further includes a movable pushing member 74*b*.

The pushing member 74*b* has a locking position segment and an unlocking position segment. When the pushing member 74*b* is located in the locking position segment, the positioning member is static radially, and keeps an axial locking state of the positioning part and the locking part, that is, the positioning member 73*b* is embedded into the positioning hole 71*b*; when the pushing member 74*b* is axially located in the unlocking position segment, the positioning member is static radially, and keeps an axial unlocking state of the positioning part and the locking part, that is, the positioning member 73*b* is separated from the positioning hole 71*b*.

Specifically, the pushing member is movable axially. More specifically, the pushing member 74*b* is movable axially in the sleeve 70*b*.

Referring to FIG. 23, the pushing member 74*b* includes a first guide surface 7421*b*, a plane 741*b* and a second guide surface 7422*b* that are connected sequentially, that is, the first guide surface 7421*b* and the second guide surface 7422*b* are located at two sides of the plane 741*b*. The plane 741*b* is parallel to the axial direction, that is, the axial direction of the output shaft.

The first and second guide surfaces 7421*b*, 7422*b* can convert axial movements thereof with respect to the output shaft 4 into radial movement of the positioning member 73*b*, that is, when the pushing member 74*b* moves axially with respect to the output shaft 4, the positioning member 73*b* moves radially under the effect of the pushing member 74*b*, thereby implementing embedding the positioning member 73*b* into the positioning hole 71*b* or removing from the positioning hole 71*b*.

The first and second guide surfaces 7421*b*, 7422*b* are inclined surfaces inclined axially with respect to the output shaft, and may also be cambered surfaces.

The plane 741*b* is located in a position of the pushing member 74*b* near the positioning hole 71*b*; when the pushing member 74*b* is located in the locking position segment, one end of the positioning member 73*b* abuts against the plane 741*b*, and in this case, the other end of the positioning member 73*b* is embedded into the positioning hole 71*b*. When the pushing member 74*b* is located in the unlocking position segment, one end of the positioning member 73*b* abuts against the guide surface, and in this case, the other end of the positioning member 73*b* is separated from the positioning hole 71*b*.

The first guide surface 7421*b* is located at one side near the tool bit 9, and the second guide surface 7422*b* is located at one side away from the tool bit 9. When the output shaft moves backward axially, the first guide surface 7421*b* abuts against the positioning member 73*b*, and when the output shaft moves forward axially, the second guide surface 7422*b* abuts against the positioning member 73*b*.

The positioning control assembly further includes a reset member. The reset member functions to reset the pushing member 74*b* from the unlocking position segment to the locking position segment. That is, the reset member enables that the pushing member 74*b* has the trend of moving from the unlocking position segment to the locking position segment.

Specifically, the reset member is an elastic member. To be differentiated with other elastic members, the elastic member is referred to as a second elastic member.

The second elastic member further includes a second elastic member 751*b* and a second elastic member 752*b*. The second elastic member 751*b* is fixed at one side of the pushing member 74*b* near the tool bit 9, and has the other end fixed on the locking arm 49*b*. The second elastic member 752*b* is fixed at one side of the pushing member 74*b* away from the tool bit 9, and has the other end also fixed on the locking arm 49*b*.

The second elastic member 751*b* and the second elastic member 752*b* may apply a pressing force or a pulling force to the pushing member 74*b*, as long as it is ensured that when the sleeve 70*b* and the output shaft 4 are locked axially, the force of the second elastic member 751*b* and the force of the second elastic member 752*b* are balanced, so that the pushing member 74*b* is axially static. Preferably, the second elastic member 751*b* and the second elastic member 752*b* are springs.

Figure 19:
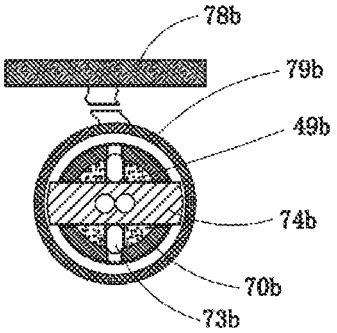
FIG. 19 is a schematic sectional diagram of the power tool in FIG. 17 taken along a line D-D.
Figure 20:
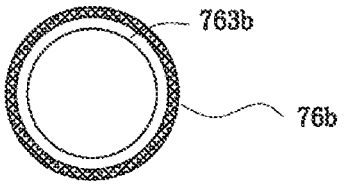
FIG. 20 is a schematic sectional diagram of a push-pull ring in FIG. 17 taken along the line D-D.
Figure 21:
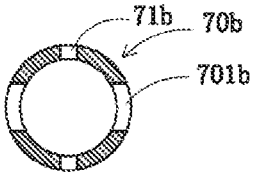
FIG. 21 is a schematic sectional diagram of a sleeve in FIG. 17 taken along the line D-D

The second elastic member 751*b* and the second elastic member 752*b* can reach force balance of the pushing member in the axial direction. Referring to FIG. 19, the second elastic member 751*b* and the second elastic member 752*b* are disposed in a parallel manner, and the pushing member 74*b* is provided with a first fixing hole for fixing the second elastic member 751*b* and a second fixing hole for fixing the second elastic member 752*b*.

Definitely, the second elastic member 751*b* and the second elastic member 752*b* may also be located on the same straight line, a first fixing surface for fixing the second elastic member 751*b* is disposed at the front end of the pushing member 74*b*, and a second fixing surface for fixing the second elastic member 752*b* is disposed at the position of the pushing member 74*b* opposite to the first fixing surface.

Definitely, the second elastic member is not limited to the above manner, and various implementation manners are also available. For example, an elastic member (for example, a spring) penetrates through the pushing member and is fixed to the pushing member, thereby implementing the function the same as that in the above manner.

The positioning control assembly further includes a positioning member reset unit, and an acting force applied by the positioning member reset unit to the positioning member is reversed to the acting force of the pushing member.

The positioning member reset unit is a cambered guide surface, and the cambered guide surface is located at the end portion of the positioning member 73*b*.

Specifically, the cambered guide surface is located at the end portion of the positioning member 73*b* near the positioning hole 71*b*. When the positioning hole 71*b* moves forward axially or moves backward axially, the positioning hole 71*b* presses against the cambered guide surface of the positioning member 73*b*, and the cambered guide surface enables the positioning member 73*b* to generate a component force toward the axis (that is, the radial direction) of the sleeve, thereby implementing the radial movement of the positioning member 73*b*, and achieving the effect that the positioning member 73*b* is separated from the positioning hole 71*b*. Definitely, a springback member may also be disposed in the positioning hole 71*b* to enable the positioning member 73*b* retract inward radially, so that the positioning member 73*b* can be separated from the positioning hole 71*b*.

The pushing member 74*b* and the second elastic member may be mounted on the locking arm, and for ease of mounting, the locking arm may be separated structures that are fixedly connected.

The pushing member is located at a radial inner side of the locking member, and specifically, the pushing member 74*b* and the second elastic member are mounted in a cavity at one end of the locking arm 4 away from the tool bit 9. In order that the pushing member 74*b* and the second elastic member can be conveniently mounted in the internal cavity, the locking arm includes a body having a cavity and a locking arm cover 492*b* covering the cavity.

The positioning control assembly further includes a push-pull ring 76*b*. The push-pull ring 76*b* annually sleeves outside the sleeve 70*b*. The push-pull ring 76*b* may move axially along the sleeve 70*b* under the pushing of an external force, and at the same time, drive the pushing member 74*b* to move axially in the sleeve 70*b*. However, the push-pull ring does not rotate. That is, the pushing member is rotatably supported in the push-pull ring.

The push-pull ring 76*b* drives the pushing member 74*b* to move axially by catching the pushing member 74*b*.

The sleeve 70*b* is provided with a through slot 701*b* that communicates the internal cavity of the sleeve and the external and extends axially, that is, the through slot 701*b* is parallel to the axis of the sleeve. The through slot 701*b* is disposed to form an angle with the positioning hole 71*b*, that is, the through slot 701*b* does not superpose the positioning hole. Preferably, the through slot 701*b* is located at the left side and the right side of the horizontal position of the sleeve, and the positioning hole is located at the top and the bottom of the vertical position of the sleeve.

The pushing member 74*b* has a clamping part, and the clamping part is disposed in a position of the pushing member 74*b* corresponding to the through slot. The clamping part may slide axially in the through slot 701*b*.

An inner peripheral surface of the push-pull ring 76*b* is provided with an annular second clamping slot 763*b*. The clamping part of the pushing member 74*b* passes through the through slot 701*b* on the sleeve 70*b* and is clamped in the second clamping slot 763*b*. As the second clamping slot 763*b* is annular, the clamping part can rotate in the second clamping slot 763*b* about the axis of the sleeve.

When the electric screw driver is in a working mode, the sleeve 70*b*, the output shaft 4, the locking arm 49*b* and the pushing member 74*b* all rotate about the axis of the sleeve, while the push-pull ring located outside the sleeve does not rotate. The clamping part can rotate in the second clamping slot 763*b* about the axis of the sleeve, and therefore, the push-pull ring will not affect the axial rotation of the pushing member.

There may be one, two or more clamping parts. To keep the stability of rotation, the clamping parts are uniformly distributed on the pushing member.

To facilitate clamping of the clamping part into the second clamping slot 763*b*, the push-pull ring 76*b* is formed by a push-pull ring body 761*b* and a push-pull ring cover 762*b* that are partitioned by a round face of the edge of the clamping slot. Definitely, the push-pull ring may also be formed by two parts that are partitioned by another round face; or may be formed by two semi-circles partitioned by a plane of the axis.

Definitely, the positioning part, the locking part, the positioning member and the restricting assembly are not limited to the above forms, and various structures meeting the restricting principle of the implementation manner are all available. For example, the positioning part may also be a positioning post disposed on the sleeve, the positioning member may be a cylinder that can accommodate the positioning post, and the locking part may be a cylinder guide slot disposed on the output shaft. When the positioning post is embedded in the cylinder, the output shaft and the sleeve are locked axially; when the positioning post is separated from the cylinder, the output shaft and the sleeve are unlocked axially. For another example, the positioning part is a positioning hole disposed on the sleeve, the locking part is a long edge of an L-shaped elastic hook fixedly disposed on the output shaft, and the positioning member is a short edge of the L-shaped hook. The long edge (that is, the locking part) of the L-shaped hook is fixed at one end of the output shaft away from the tool bit, and the short edge of the L-shaped hook is a free end that can be embedded into or separated from the positioning hole. The positioning control assembly includes a wedged pushing member, and when the wedged pushing member moves axially toward the tool bit, the wedged pushing member abuts against the corner of the hook, the long edge of the L-shaped hook bends outward, and the short edge of the L-shaped hook extends radially outward to be embedded into the positioning hole; when the wedged pushing member moves axially away from the tool bit, the abutting of the wedged pushing member on the hook is released, and under the elastic force of the L-shaped hook itself, the long edge of the L-shaped hook moves inward, and the short edge of the L-shaped hook resets inwards to be separated from the positioning hole.

The housing 1 is connected to an operating assembly, and the operating assembly is operable to control the pushing member 74*b* to move.

Further, the operating assembly includes an operating member 78*b* disposed at the external of the housing 1 and an operation connecting member 79*b* connecting the operating member 78*b* and the push-pull ring 76*b*. The housing 1 is provided with a chute (not shown) extending axially, and the operation connecting member 79*b* passes through the chute to connect the operating member 78*b* and the push-pull ring 76*b*. The operation connecting member 79*b* may be a pin, a screw, or the like, and may also be a flexible rope. By such a configuration, dust and other things may be prevented from falling into the housing 1, and in order to further enhance the sealing effect, a flexible sealing strip that does not affect moving of the operation connecting member 79*b* may be connected to the chute.

Definitely, the operating member 78*b* and the push-pull ring 76*b* may also be configured integrally, so that a foldable sealing device is disposed between the operating member 78*b* and the housing 1 for dust proofing.

The process of quick switch of a working state of an output shaft in the third implementation manner of an electric screw driver according to the implementation manner is described in detail.

When the output shaft 4 is in the working position, that is, when the positioning member 73*b* is embedded in the positioning hole 71*b*, the work of tightening up the screw may be conducted by pressing the button switch 19. In this case, the motor drives, through the transmission mechanism, the sleeve to rotate, the sleeve drives the output shaft to rotate, and the output shaft drives the tool bit to rotate.

Figure 24:
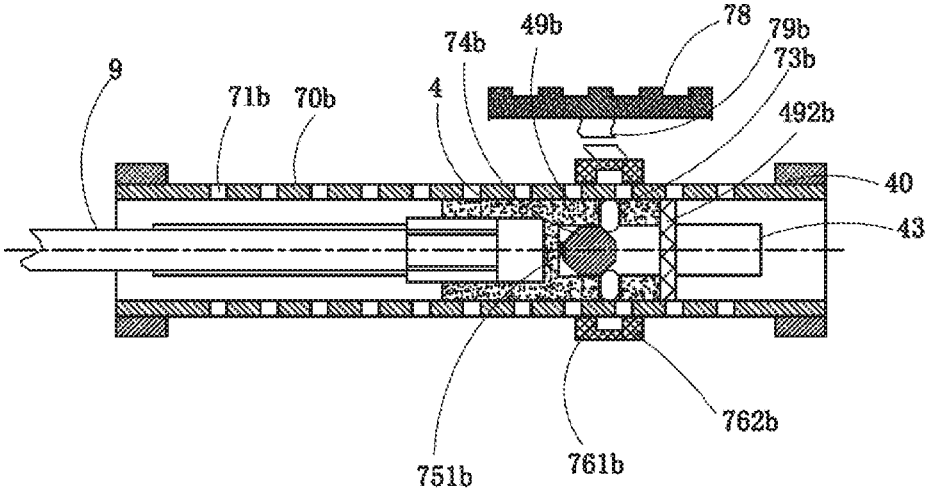
FIG. 24 is a schematic sectional diagram of the output shaft in FIG. 17 in which locking of axial forward movement is released.

Referring to FIG. 17, FIG. 18 and FIG. 24, when the tool bit 9 needs to be inserted into a small space for operation, the operator pushes the operating member 78*b* forward along the chute on the housing 1; the operating member 78*b* drives the push-pull ring 76*b* to move forward along the periphery of the sleeve 70*b*; at the same time, the pushing member 74*b* caught in the push-pull ring 76*b* also moves forward, the pushing member 74*b* presses the second elastic member 751*b* and stretches the second elastic member 752*b*, so that the second elastic members 751*b*, 752*b* deform. The second elastic members 751*b*, 752*b* apply a forward force to the locking arm 49*b*, and the positioning member 73*b* located in the lock hole 72*b* applies a forward force to the positioning hole 71*b*, the positioning member 73*b* is subjected to a reversed force of the positioning hole 71*b*, that is, the hole wall of the positioning hole 71*b* presses the outer end of the positioning member, but since the plane abuts against the inner end of the positioning member 73*b*, the positioning member 73*b* does not shift radially. As the positioning member 73*b* is further embedded in the positioning hole 71*b*, in this case, the output shaft 4 cannot move forward axially. When the plane of the pushing member 74*b* is driven away from the positioning member 73*b*, the positioning member 73*b* abuts against the second guide surface 7422*b*, and since the second guide surface 7422*b* is an inclined surface, the positioning member 73*b* shifts radially under the pressing of the positioning hole 71*b*, so as to retract toward the axis.

When the positioning member 73*b* abuts against the tail end of the second guide surface, the positioning member 73*b* is completely separated from the positioning hole 71*b*, and the locking arm 49*b* moves forward under the effect of the second elastic members 751*b*, 752*b*, and also drives the output shaft 4 to move forward.

When the operator releases the forward force applied to the operating member 78*b*, the second elastic members 751*b*, 752*b* generate forces for restoring the pushing member 74*b* to the initial position. The second guide surface 7422*b* of the pushing member 74*b* pushes the positioning member 73*b*, and the positioning member 73*b* extends out of the lock hole 72*b* radially to be embedded into the positioning hole 71*b*, so that the sleeve 70*b* and the locking arm 49*b* are locked axially. Then, the pushing member 74*b* continuously moves backward axially, until the positioning member 73*b* enters the plane of the pushing member 74*b* and stops moving axially.

In this case, the length of the tool bit 9 extending out of the housing 1 is large, the tool bit 9 can be inserted into the small space, and the work of tightening up the screw may be conducted by pressing the button switch 19.

Figure 25:
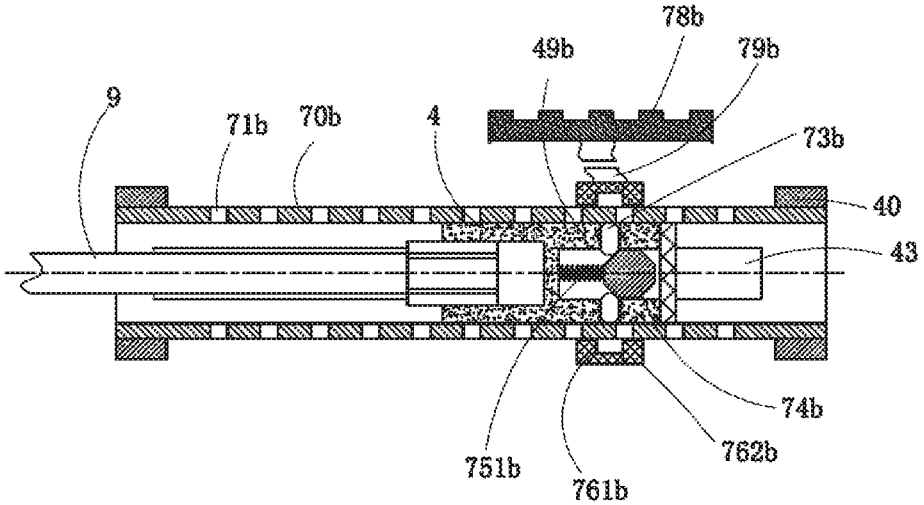
FIG. 25 is a schematic sectional diagram of the output shaft in FIG. 17 in which locking of axial backward movement is released.

Likewise, referring to FIG. 17, FIG. 18 and FIG. 25, when the tool bit 9 needs to be retracted into the housing, in this case, the operator pushes the operating member 78*b* backward along the chute on the housing 1; the operating member 78*b* drives the push-pull ring 76*b* to move backward along the periphery of the sleeve 70*b*; at the same time, the pushing member 74*b* caught in the push-pull ring 76*b* also moves backward, the pushing member 74*b* presses the second elastic member 752*b* and stretches the second elastic member 751*b*, so that the second elastic members 751*b*, 752*b* deform. The second elastic members 751*b*, 752*b* apply backward forces to the locking arm 49*b*, and the positioning member 73*b* located in the lock hole 72*b* applies a backward force to the positioning hole 71*b*, the positioning member 73*b* is subjected to a reversed force of the positioning hole 71*b*, that is, the hole wall of the positioning hole 71*b* presses the outer end of the positioning member, but since the plane abuts against the inner end of the positioning member 73*b*, the positioning member 73*b* does not shift radially. The positioning member 73*b* is embedded in the positioning hole 71*b*, and therefore, in this case, the output shaft 4 cannot move backward axially; when the plane of the pushing member 74*b* is driven away from the positioning member 73*b*, the positioning member 73*b* abuts against the first guide surface 7421*b*, and since the first guide surface 7421*b* is an inclined surface, the positioning member 73*b* shifts radially under the pressing of the positioning hole 71*b*, so as to retract toward the axis.

When the positioning member 73*b* abuts against the tail end of the first guide surface, the positioning member is completely separated from the positioning hole 71*b*, and the locking arm 49*b* moves backward under the effect of the second elastic members 751*b*, 752*b*, and also drives the output shaft 4 to move backward.

When the operator releases the backward force applied to the operating member 78*b*, the second elastic members 751*b*, 752*b* generate forces for restoring the pushing member 74*b* to the initial position. The first guide surface 7421*b* of the pushing member 74*b* pushes the positioning member 73*b*, and the positioning member 73*b* extends out of the lock hole 72*b* radially to be embedded into the positioning hole 71*b*, so that the sleeve 70*b* and the locking arm 49*b* are locked axially. Then, the pushing member 74*b* continuously moves forward axially, until the positioning member 73*b* enters the plane of the pushing member 74*b* and stops moving axially.

In this case, the length of the tool bit 9 extending out of the housing 1 is small, and the work of tightening up the screw may be conducted by pressing the button switch 19.

In the third implementation manner, a magnetic structure may also be used to reset the pushing member, and a specific configuration manner may be easily changed by persons skilled in the art according to the above implementation manner, and is not repeated herein.

FIG. 26 to FIG. 29 show a fourth preferred implementation manner of the present invention, and in the fourth implementation manner, structures and functions of the housing, the motor, the transmission mechanism, the output shaft, the button switch and the like are the same as those in the third preferred implementation manner, and are not repeated herein.

The restricting mechanism of the fourth preferred implementation manner is slightly different from that in the third preferred implementation manner, and the restricting principle and specific structure of the fourth preferred implementation manner are described in detail.

Figure 26:
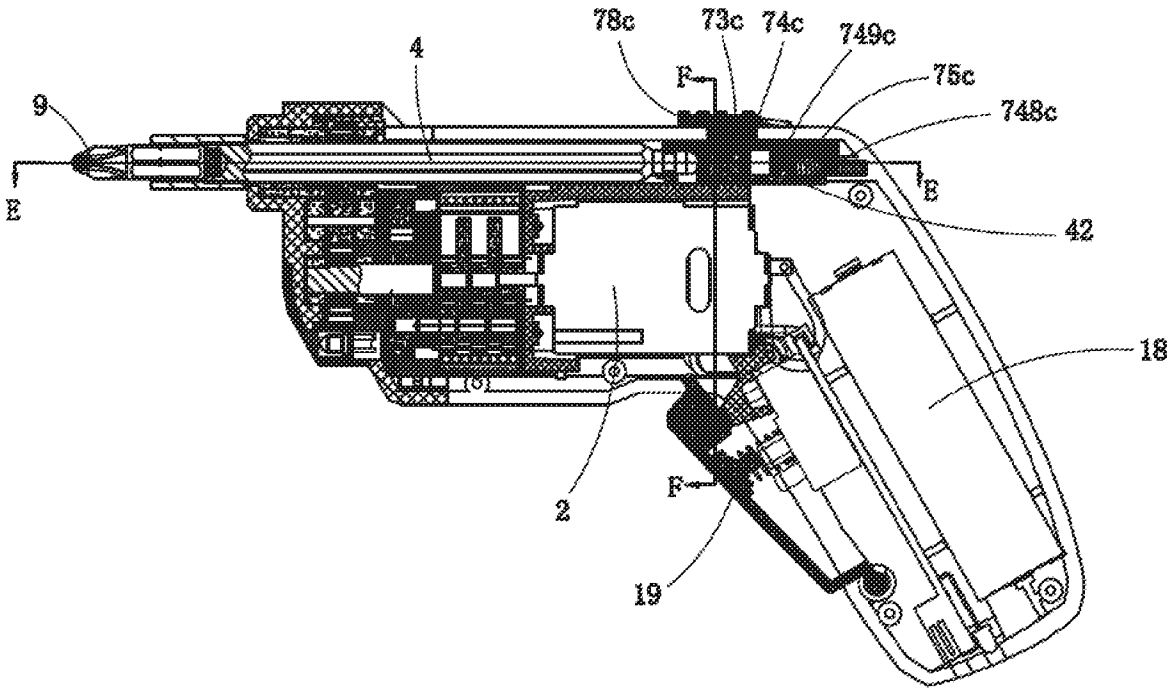
FIG. 26 is a schematic sectional diagram of a power tool according to a fourth preferred implementation manner of the present invention.

Referring to FIG. 26, in the fourth preferred implementation manner, a reference member 70 is fixed on the housing, and therefore, the reference member is static axially with respect to the housing. In the implementation manner, the locking member is a supporting member 42, one end of the output shaft 4 away from the tool bit is rotatably supported on the supporting member 42, and the supporting member 42 drives the output shaft 4 to move axially. The supporting member 42 is the same as the support block in the first and second implementation manners, and is not repeated herein.

In the implementation manner, the restricting mechanism may also drive the output shaft to move axially.

Correspondingly, the restricting mechanism includes a positioning part disposed on the reference member 70, and a locking part disposed on the supporting member 42, that is, a positioning member 73*c* that moves radially.

The restricting mechanism also includes a positioning control assembly that controls the positioning member 73*c* to axially lock the positioning part and the locking part or release the axial locking of the positioning part and the locking part.

When the positioning member 73*c* axially locks the positioning part and the locking part, the axial locking of the reference member 70 and the output shaft 4 is implemented; and when the positioning member 73*c* releases the axial locking between the positioning part and the locking part, the output shaft 4 can move freely with respect to the reference member 70 in the axial direction.

Figure 27:
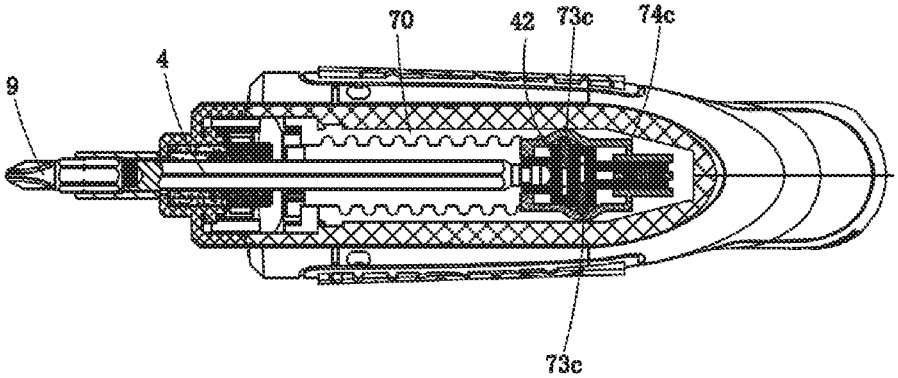
FIG. 27 is a schematic sectional diagram of the power tool in FIG. 26 taken along a line E-E.
Figure 28:
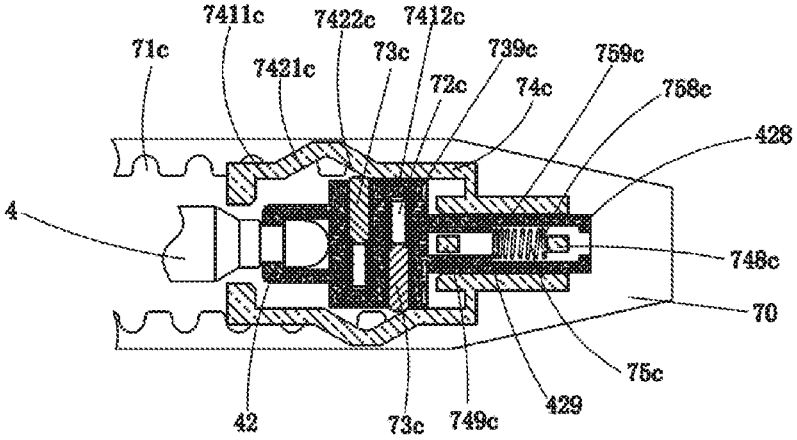
FIG. 28 is a partially enlarged sectional diagram of a restricting mechanism in FIG. 27.

Referring to FIG. 27 and FIG. 28, the reference member 70 is a positioning caliper fixedly disposed on the inner wall of the housing 1, the positioning part is a positioning hole 71*c* disposed on the positioning caliper; the locking part is a lock hole 72*c* disposed on the supporting member 42; and the positioning member 73*c* is located in the lock hole 72*c* and can be partially embedded into the positioning hole 71*c*.

Likewise, the positioning holes 71*c* are one-to-one corresponding to the working positions of the output shaft 4. Several positioning holes 71*c* form a positioning hole column, and the positioning hole column is distributed linearly in a direction parallel to the axial direction of the output shaft 4. On the positioning caliper, there are two positioning hole columns disposed correspondingly left and right. Definitely, there may be one positioning hole column.

Specifically, the positioning hole 71*c* may be a positioning clamping slot.

The lock hole 72*c* is disposed at one end of the supporting member 42 away from the output shaft 4.

In order to better adapt to the internal structure of the electric screw driver, two lock holes are disposed sequentially in the axial direction of the supporting member 42, and hole openings of the two lock holes face opposite directions.

Under the effect of the positioning control assembly, the positioning member 73*c* located in the lock hole 72*c* may be embedded into the positioning hole 71*c* or separated from the positioning hole 71*c*. When the positioning member 73*c* is embedded into the positioning hole 71*c*, the output shaft 4 and the reference member 70 are locked axially, that is, the output shaft 4 cannot move axially in the housing 1; when the positioning member 73*c* is separated from the positioning hole 71*c*, the output shaft 4 and the reference member 70 are unlocked axially, and the output shaft 4 can move axially in the housing 1.

When the positioning member 73*c* extends from the lock hole 72*c* and is embedded into the positioning hole 71*c*, a part of the positioning member 73*c* is located in the lock hole 72*c* and the other part is located in the positioning hole 71*c*, so that the supporting member 42 cannot move axially with respect to the housing 1; therefore, the output shaft 4 cannot move axially with respect to the housing 1. When the positioning member 73*c* is separated from the positioning hole 71*c* and retracts into the lock hole 72*c*, the axial movement locking between the supporting member 42 and the housing 1 is released, and therefore, the output shaft 4 can move axially with respect to the housing 1.

The positioning control assembly further includes a pushing member 74*c* that is movable axially.

The pushing member 74*c* is provided with a locking position segment and an unlocking position segment in the axial direction. When the pushing member 74*c* is located in the locking position segment, the positioning member 73*c* is static radially, and keeps an axial locking state of the positioning part and the locking part, that is, the positioning member 73*c* is embedded into the positioning hole 71*c*; when the pushing member 74*c* is axially located in the unlocking position segment, the positioning member 73*c* is static radially, and keeps an axial unlocking state of the positioning part and the locking part, that is, the positioning member 73*c* is separated from the positioning hole 71*c*.

The pushing member 74*c* can move axially in the housing 1, and the pushing member 74*c* can convert the axial movement thereof with respect to the supporting member 42 into radial movement of the positioning member 73*c*, that is, when the pushing member 74*c* moves axially with respect to the supporting member 42, the positioning member 73*c* moves radially under the effect of the pushing member 74*c*, and therefore, the positioning member 73*c* is embedded into the positioning hole 71*c* or separated from the positioning hole 71*c*.

Figure 29:
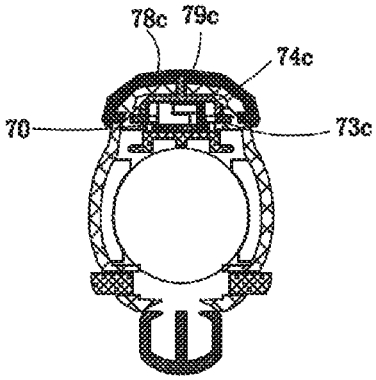
FIG. 29 is a schematic sectional diagram of the power tool in FIG. 26 taken along a line F-F.

Referring to FIG. 29, the pushing member 74*c* is cover-shaped, and is located above the positioning caliper. Moreover, the pushing member partially covers the positioning member 73*c* and the supporting member 42. The bottom portion of the outer side of the positioning member 73*c* is embedded into the positioning hole 71*c* of the positioning caliper, and the upper portion of the outer side thereof contacts with the inner side face of the pushing member 74*c*.

Referring to FIG. 27 and FIG. 28, the pushing member 74*c* includes a first plane 7411*c*, a first guide surface 7421*c*, a second guide surface 7422*c* and a second plane 7412*c* that are connected sequentially, and the first plane 7411*c*, the first guide surface 7421*c*, the second guide surface 7422*c* and the second plane 7412*c* are all located on the inner side face of the pushing member 74*c*.

The first plane and the second plane are coplanar, and are parallel to the axial direction, that is, parallel to the axis of the output shaft.

The first guide surface and the second guide surface are respectively located at two sides of a middle interface (not shown); the middle interface passes through an intersecting line of the first and second guide surfaces and is perpendicular to the axial direction of the output shaft. When the positioning member abuts against the first and second guide surfaces, the axial movement of the pushing member is converted into the radial movement of the positioning member. When the output shaft moves axially away from the tool bit, the positioning member abuts against the first guide surface; when the output shaft moves axially toward the tool bit, the positioning member abuts against the second guide surface.

When the pushing member 74*c* is located in the locking position segment, the upper portion of the outer side of the positioning member 73*c* abuts against an included angle of the two guide surfaces, and in this case, the bottom portion of the positioning member 73*c* is embedded into the positioning hole 71*c*. When the pushing member 74*c* is located in the unlocking position segment, the upper portion of the outer side of the positioning member 73*c* abuts against the first and second planes, and in this case, the bottom portion of the positioning member 73*c* is separated from the positioning hole 71*c*.

The first plane 7411*c* and the first guide surface 7421*c* are located at one side near the tool bit 9, and the second guide surface 7422*c* and the second plane 7412*c* are located at one side away from the tool bit 9. When the output shaft 4 moves backward axially, the first guide surface 7421*c* and the first plane 7411*c* abut against the positioning member 73*c*; and when the output shaft 4 moves forward axially, the second guide surface 7422*c* and the second plane 7412*c* abut against the positioning member 73*c*.

The positioning control assembly further includes a reset member, and the reset member functions to reset the pushing member 74*c* from the unlocking position segment to the locking position segment, that is, the reset member enables the pushing member have the trend of resetting from the unlocking position segment to the locking position segment.

The reset member is an elastic member, and the elastic member herein is basically the same as that in the third implementation manner, and is referred to as the second elastic member.

The second elastic member 75*c* is disposed between the supporting member 42 and the pushing member 74*c*. The supporting member 42 is provided with a first stopping arm 428 and a second stopping arm 429, the pushing member 74*c* is correspondingly provided with a first pushing arm 748*c* and a second pushing arm 749*c*, and the second elastic member 75*c* has a first end 758*c* and a second end 759*c*. The second elastic member 75*c* is located between the first and second stopping arms 428, 429, and is also located between the first and second pushing arms 748*c*, 749*c*. That is, the first end 758*c* of the second elastic member 75*c* abuts against the first stopping arm 428 or the first pushing arm 748*c*, and the second end 759*c* thereof abuts against the second pushing arm 749*c* or the second stopping arm 429.

When the pushing member 74*c* moves forwards, that is, moves toward the tool bit 9, the first pushing arm 748*c* of the pushing member 74*c* presses the first end 758*c* of the second elastic member 75*c*, and at the same time, the second end 759*c* of the second elastic member 75*c* is pressed against the second stopping arm 429 of the supporting member 42. When the pushing member 74*c* moves backward, that is, moves away from the tool bit 9, when the second pushing arm 749*c* of the pushing member 74*c* presses the second end 759*c* of the second elastic member 75*c*, the first end 758*c* of the second elastic member 75*c* is pressed against the first stopping arm 428 of the supporting member 42.

The positioning control assembly further includes a positioning member reset unit, and an acting force applied by the positioning member reset unit to the positioning member is reversed to the acting force of the pushing member.

Specifically, the positioning member reset unit is an elastic member, and is referred to as a third elastic member.

The elastic force of the third elastic member 739*c* may enable the positioning member 73*c* partially extend out of the lock hole 72*c*. Preferably, the third elastic member 739*c* is located at the bottom portion of the lock hole 72*c*.

The restricting mechanism further includes an operating assembly connected to the housing 1, and the operating assembly is operable to control the pushing member 74*c* to move.

Further, the operating assembly includes an operating member 78*c* disposed at the external of the housing 1, and the operating member 78*c* moves axially.

Further, the operating assembly includes an operation connecting member connecting the pushing member 74*c* and the operating member 78*c*.

The operating assembly is basically the same as that in the third preferred implementation manner, and is not repeated herein.

The process of quick switch of a working state of the output shaft in the fourth implementation manner of an electric screw driver according to the present invention is described in detail.

When the output shaft 4 is in a working position, that is, the positioning member 73*c* is embedded in the positioning hole 71*c*, the work of tightening up a screw may be conducted by pressing the button switch 19. In this case, the motor 2 drives, through the transmission mechanism 3, the output shaft 4 to rotate, and the output shaft 4 drives the tool bit 9 to rotate.

Referring to FIG. 26 to FIG. 29, when the tool bit 9 needs to be inserted into a small space for operation, the operator pushes the operating member 78*c* forward along the chute on the housing 1; the operating member 78*c* drives, through the operation connecting member 79*c*, the pushing member 74*c* to move forward as well, the first pushing arm 748*c* of the pushing member 74*c* presses the first end 758*c* of the second elastic member 75*c*, and in this case, the second end 759*c* of the second elastic member 75*c* is pressed against the second stopping arm 429 of the supporting member 42, and the second elastic member 75*c* is compressed.

At the same time, the second guide surface 7422*c* of the pushing member 74*c* is pressed against the upper portion of the positioning member 73*c*, and the second guide surface 7422*c* is an inclined surface, so that the positioning member 73*c* shifts radially under the pressing of the second guide surface 7422*c*, so as to retract into the lock hole 72*c*. At the same time, the bottom portion of the positioning member 73*c* is gradually separated from the positioning hole 71*c*. In this case, the third elastic member 739*c* located in the lock hole 72*c* is compressed.

The positioning member 73*c* is not completely separated from the positioning hole 71*c*, and the positioning member 73*c* is partially embedded into the positioning hole 71*c*; therefore, in this case, the output shaft 4 cannot move forward axially.

When the bottom portion of the positioning member 73*c* is completely separated from the positioning hole 71*c*, in this case, the top portion of the positioning member 73*c* abuts against the second plane 7412*c*, and the output shaft 4 can move axially with respect to the housing 1. In this case, the pushing member 74*c* transmits the pushing force to the supporting member 42 through the second elastic member 75*c*, and the supporting member 42 moves forward axially under the driving of the pushing member 74*c*.

When the operator releases the forward force applied to the operating member 78*c*, the compressed second elastic member 75*c* generates a force for restoring the pushing member 74*c* to the initial position, that is, the second elastic member 75*c* pushes the pushing member 74*c* backward. When the second plane 7412*c* of the pushing member 74*c* is driven away from the positioning member 73*c*, the positioning member 73*c* abuts against the second guide surface 7422*c*, the third elastic member 739*c* is stretched, and the positioning member 73*c* is partially extended out of the lock hole 72*c* under the effect of the third elastic member 739*c* to be embedded into the positioning hole 71*c*, so that the housing 1 and the supporting member 42 are locked axially.

In this case, the length of the tool bit 9 extending out of the housing 1 is large, the tool bit 9 can be inserted into the small space, and the work of tightening up the screw may be conducted by pressing the button switch 19.

Likewise, when the tool bit 9 needs to be retracted into the housing, in this case, the operator pushes the operating member 78*c* backward along the chute on the housing 1; the operating member 78*c* drives, through the operation connecting member 79*c*, the pushing member 74*c* to move backward as well, the second pushing arm 749*c* of the pushing member 74*c* presses the second end 758*c* of the second elastic member 75*c*, and in this case, the first end 759*c* of the second elastic member 75*c* is pressed against the first stopping arm 428 of the supporting member 42, and the second elastic member 75*c* is compressed.

At the same time, the first guide surface 7421*c* of the pushing member 74*c* is pressed against the upper portion of the positioning member 73*c*, and the first guide surface 7421*c* is an inclined surface, so that the positioning member 73*c* shifts radially under the pressing of the first guide surface 7421*c*, so as to retract into the lock hole 72*c*. At the same time, the bottom portion of the positioning member 73*c* is gradually separated from the positioning hole 71*c*.

The positioning member 73*c* is not completely separated from the positioning hole 71*c*, and the positioning member 73*c* is partially embedded into the positioning hole 71*c*; therefore, in this case, the output shaft 4 cannot move backward axially.

When the bottom portion of the positioning member 73*c* is completely separated from the positioning hole 71*c*, in this case, the top portion of the positioning member 73*c* abuts against the first plane 7411*c*, and the output shaft 4 can move axially with respect to the housing 1. In this case, the pushing member 74*c* transmits the pushing force to the supporting member 42 through the second elastic member 75*c*, and the supporting member 42 moves backward axially under the driving of the pushing member 74*c*.

When the operator releases the forward force applied to the operating member 78*c*, the compressed second elastic member 75*c* generates a force for restoring the pushing member 74*c* to the initial position, that is, the second elastic member 75*c* pushes the pushing member 74*c* backward. When the first plane 7411*c* of the pushing member 74*c* is driven away from the positioning member 73*c*, the positioning member 73*c* abuts against the first guide surface 7421*c*, the third elastic member 739*c* is stretched, and the positioning member 73*c* is partially extended out of the lock hole 72*c* under the effect of the third elastic member 739*c* to be embedded into the positioning hole 71*c*, so that the housing 1 and the supporting member 42 are locked axially.

In this case, the length of the tool bit 9 extending out of the housing 1 is small, and the work of tightening up the screw may be conducted by pressing the button switch 19.

Figure 30:
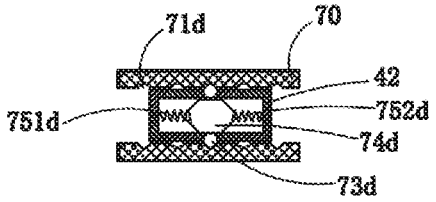
FIG. 30 is a schematic three-dimensional diagram of a restricting mechanism of a power tool according to a fifth preferred implementation manner of the present invention.

FIG. 30 shows a fifth preferred implementation manner of the present invention, and in the fifth implementation manner, structures and functions of the housing, the motor, the transmission mechanism, the output shaft, the supporting member, the operating member, the button switch and the like are the same as those in the fourth embodiment, and are not repeated herein.

Structures and functions of the positioning part, the locking part, the positioning member, the pushing member, the second elastic member and the positioning member reset unit are basically the same as those in the third implementation manner.

Referring to FIG. 30 and FIG. 17, different from the third implementation manner: in the third implementation manner, the reference member is a sleeve, the restricting mechanism functions between the locking arm and the sleeve, and during working, the locking arm and the sleeve both rotate; in the fifth implementation manner, the reference member 70 is secured on the housing, the restricting mechanism functions between the supporting member 42 and the reference member 70, and correspondingly, the positioning hole 71*d* is disposed on the reference member 70, the lock hole is disposed on the supporting member 42, no push-pull ring is provided, and the pushing member 74*d* is directly connected to the operating assembly.

The supporting member 42 and the reference member 70 do not rotate, and therefore, the positioning hole 71*d*, the lock hole, the positioning member 73*d*, the pushing member 74*d*, and the second elastic members 751*d*, 752*d* do not rotate as well, but the axial movement and radial movement thereof are the same as those in the third implementation manner, which are not repeated herein.

Figure 31:
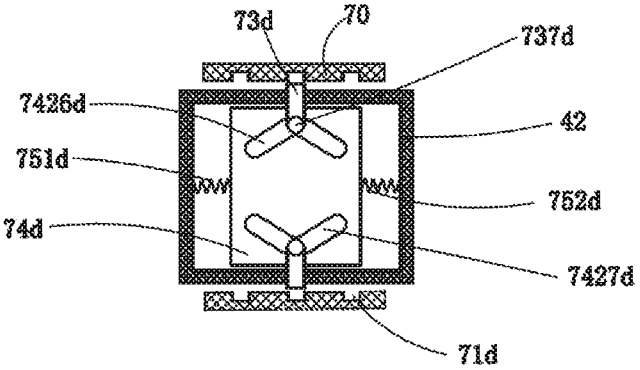
FIG. 31 is a schematic sectional diagram of a restricting mechanism of a power tool according to a sixth preferred implementation manner of the present invention.
Figure 32:
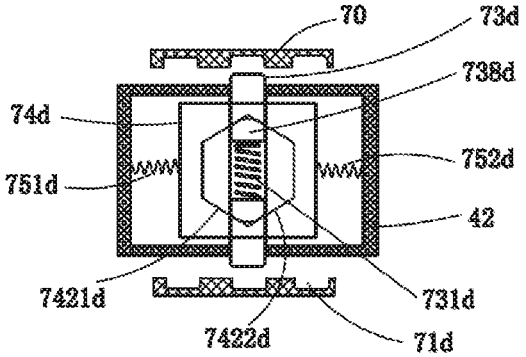
FIG. 32 is a schematic structural diagram of a restricting mechanism of a power tool according to a seventh preferred implementation manner of the present invention.

FIG. 31 and FIG. 32 show sixth and seventh preferred implementation manners of the present invention. The sixth implementation manner and the seventh implementation manner are basically similar to the fifth implementation manner, except for functional relations of the pushing member 74*d* controlling the positioning member 73*d* to be embedded in and separated from the positioning hole 71*d*, others are all the same as those in the fifth implementation manner, which are not repeated herein.

In the sixth implementation manner, referring to FIG. 31, one end of the positioning member 73*d* away from the positioning hole 71*d* is provided with a protruding guide post 737*d*, the pushing member 74*d* is provided with a guide slot, and the guide post 737*d* is embedded in the guide slot and is movable in the guide slot.

The guide slot includes a first sub-guide slot 7426*d* and a second sub-guide slot 7427*d*, the first sub-guide slot 7426*d* is used for the output shaft moving axially away from the tool bit, and the second sub-guide slot 7427*d* is used for the output shaft moving axially close to the tool bit.

Control on the pushing member 74*d* and the positioning member 73*d* is implemented by means of the functional relations between the first and second sub-guide slots 7426*d*, 7427*d* and the guide post 737*d*.

In the seventh implementation manner, referring to FIG. 32, the positioning member 73*d* is provided with a protruding guide block 738*d* perpendicular to the radial direction and the axial direction, and the guide block 738*d* is located at one end away from the positioning hole 71*d*.

A hole is provided in the pushing member 74*d*, and the guide block 738*d* is located in the hole and movable in the hole. An inner wall of the hole is provided with a first guide surface 7421*d* and a second guide surface 7422*d*.

Control on the pushing member 74*d* and the positioning member 73*d* is implemented by means of the functional relations between the first and second guide surfaces 7421*d*, 7422*d* and the guide block 738*d*.

In an eighth implementation manner, the pushing member 74*d*, the second elastic members 751*d*, 752*d* and the second operating assembly are all the same as those in the fifth implementation manner, and are not repeated herein.

Figure 33:
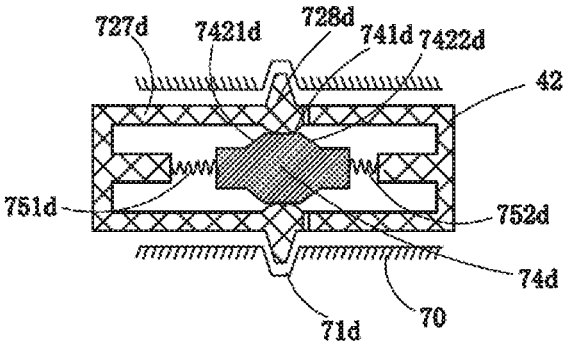
FIG. 33 is a schematic structural diagram of a restricting mechanism of a power tool according to an eighth preferred implementation manner of the present invention.

Referring to FIG. 33, the positioning part is a positioning hole disposed on the housing 1, the locking part is an elastic arm 727*d* fixedly disposed on the supporting member, the positioning member is a positioning bump 728*d* located at the free end of the elastic arm 727*d*, the positioning bump 728*d* can be embedded in or separated from the positioning hole 71*d*, and the elastic arm 727*d* is fixed at one end of the supporting member 42 near the output shaft.

The elastic force of the elastic arm 727*d* can make the positioning bump 728*d* separated from the positioning hole 71*d*. When the positioning bump 728*d* is embedded in the positioning hole 71*d*, the positioning bump 728*d* fixes the supporting member 42 axially with the elastic arm 727*d*, that is, axially locks the output shaft. When the positioning bump 728*d* is separated from the positioning hole 71*d*, the elastic arm 727*d* may move axially, the supporting member 42 connected to the elastic arm 727*d* may also move axially, that is, the output shaft is unlocked axially.

The functional relation between the pushing member 74*d* and the positioning member 73*d* is the same as that in the fifth implementation manner, and is not repeated herein In the fifth, sixth, seventh and eighth implementation manners, the restricting mechanism may also drive the output shaft to move axially.

Figure 34:
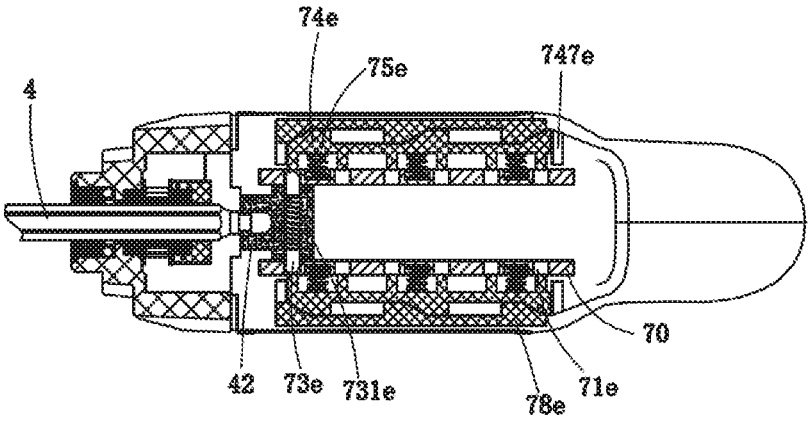
FIG. 34 is a schematic sectional diagram of a power tool according to a ninth preferred implementation manner of the present invention, and in this case, a pushing member is in a locking position segment.
Figure 35:
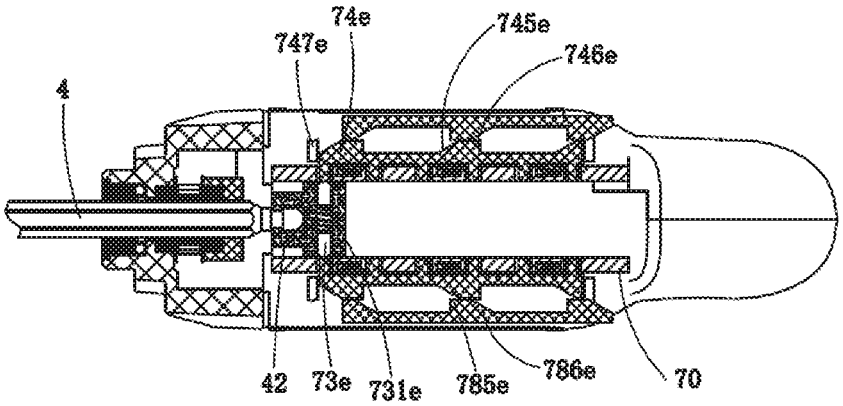
FIG. 35 is a schematic diagram of the pushing member in FIG. 34 in an unlocking position segment.
Figure 36:
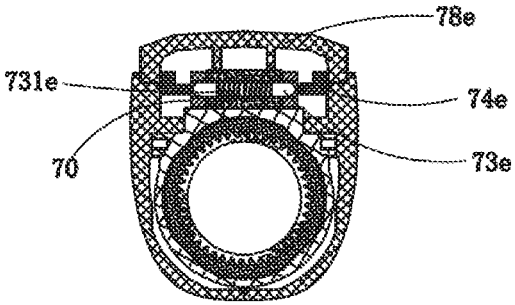
FIG. 36 is a schematic radial sectional diagram of the power tool in FIG. 34.

FIG. 34 to FIG. 36 show a ninth preferred implementation manner of the present invention, and in the ninth implementation manner, structures and functions of the housing, the motor, the transmission mechanism, the output shaft, the supporting member, the button switch and the like are the same as those in the fourth implementation manner, and are not repeated herein.

Referring to FIGS. 34 to 36, the positioning part is several positioning holes 71*e* disposed on the reference member 70; the locking part is a lock hole disposed on the supporting member 42; and the positioning member 73*e* is located in the lock hole and can be partially embedded in the positioning hole 71*e*.

Specifically, the positioning hole 71*e* is a through hole disposed on the reference member 70, and communicates internal and external of the reference member 70. The positioning holes 71*e* are one-to-one corresponding to the working positions of the output shaft 4. The several positioning holes form a positioning hole column, and the positioning hole column is distributed linearly in a direction parallel to the axial direction of the output shaft 4. On the reference member 70, there are two positioning hole columns disposed correspondingly left and right. Definitely, there may be one positioning hole column.

Likewise, the lock hole is disposed at one end of the supporting member 42 away from the output shaft 4. Different from the fourth preferred implementation manner, the lock hole is a through hole that penetrates through the supporting member, and the third elastic member 731*e* is located at the middle portion of the lock hole.

Under the effect of the positioning control assembly, the positioning member 73*e* located in the lock hole may be embedded in the positioning hole 71*e* or separated from the positioning hole 71*e*. When the positioning member 73*e* is embedded in the positioning hole 71*e*, the output shaft 4 and the reference member 70 are axially locked, that is, the output shaft 4 cannot move axially in the housing 1; when the positioning member 73*e* is separated from the positioning hole 71*e*, the output shaft 4 and the reference member 70 are axially unlocked, and the output shaft 4 can move axially in the housing 1.

When the positioning member 73*e* is extended out of the lock hole and embedded in the positioning hole 71*e*, a part of the positioning member 73*e* is located in the lock hole and the other part is located in the positioning hole 71*e*, so that the supporting member 42 cannot move axially with respect to the housing 1; therefore, the output shaft 4 cannot move axially with respect to the housing 1. When the positioning member 73*e* is separated from the positioning hole 71*e* to retract into the lock hole, the locking on the axial movement between the supporting member 42 and the housing 1 is released, and therefore, the output shaft 4 can move axially with respect to the housing 1.

The positioning control assembly further includes a pushing member 74*e* that is movable radially. The pushing member 74*e* can push the positioning member 73*e* out of the positioning hole 71*e* from the outer end of the positioning hole 71*e* (that is, one end away from the supporting member 42). The pushing member 74*e* is located at the outer end of the housing 1.

Two axial ends of the pushing member 74*e* are provided with pushing member stopping blocks 747*e*, and the pushing member stopping blocks 747*e* restrict the axial movement of the pushing member 74*e*.

The pushing member 74*e* has a locking position segment and an unlocking position segment in the radial direction; when the pushing member 74*e* is radially located in the locking position segment, the pushing member 74*e* is separated from the positioning hole 71*e*, and the positioning member 73*e* is embedded in the positioning hole 71*e*; when the pushing member 74*e* is radially located in the unlocking position segment, the pushing member 74*e* is partially embedded in the positioning hole 71*e* to make the positioning member 73*e* separated from the positioning hole 71*e*.

The positioning control assembly further includes a reset member. The reset member functions to reset the pushing member 74*e* from the unlocking position segment to the locking position segment.

Specifically, the reset member is an elastic member, and is also referred to as a second elastic member.

The second elastic member 75*e* is disposed between the pushing member 74*e* and an outer surface of the reference member 70.

The restricting mechanism further includes an operating member connected to housing 1, in this case, it is referred to as a third operating member, and the third operating member 78*e* is operable to control the pushing member 74*e* to move radially.

The pushing member 74*e* includes a protruding bump that can be embedded in the positioning hole 71*e*, and a movement guiding part located at one end away from the protruding bump.

The movement guiding part has a first abutting surface 745*e* and a first inclined surface 746*e* connected to the first abutting surface 745*e*, and the operating member has a second abutting surface 785*e*, and a second inclined surface 786*e* connected to the second abutting surface 785*e*. The first inclined surface 746*e* is parallel to the second inclined surface 786*e*. When the first abutting surface 745*e* abuts against the second abutting surface 785*e*, the pushing member 74*e* is located in the unlocking position segment, the protruding bump is embedded in the positioning hole 71*e*; when the first inclined surface 746*e* abuts against the second inclined surface 786*e*, the pushing member 74*e* is located in the locking position segment, and the protruding bump is separated from the positioning hole 71*e*.

As shown in FIG. 36, the third operating member 78*e* is located above the housing 1, and is a structure half surrounded. The second abutting surface 785*e* and the second inclined surface 786*e* are located on the inner side face of the third operating member 78*e*.

The process of quick switch of a working state of the output shaft in the ninth implementation manner of an electric screw driver according to the present invention is described in detail.

When the output shaft 4 is in the working position, that is, the positioning member 73*e* is embedded in the positioning hole 71*e*, as shown in FIG. 34, and in this case, the work of tightening up a screw may be conducted by pressing the button switch 19. In this case, the motor 2 drives, through the transmission mechanism 3, the output shaft 4 to rotate, and the output shaft 4 drives the tool bit 9 to rotate.

Referring to FIG. 35, when the length of the output shaft 4 extending out of the housing 1 needs to be adjusted, the operator pushes the third operating member 78*e* to move backward along the chute on the housing 1; the second inclined surface 786*e* of the third operating member 78*e* presses against the first inclined surface 746*e* of the pushing member 74*e*, and since the pushing member 74*e* can only move radially, the third operating member 78*e* moves backward axially, the axial movement is converted, through the first and second inclined surfaces 746*e*, 616, into the inward movement of the pushing member 74*e* in the radial direction, and the second elastic member 75*e* is compressed. The protruding bump located in the pushing member 74*e* presses the positioning member 73*e* in the positioning hole 71*e*, so that the positioning member 73*e* retracts radially, and the third elastic member 731*e* is compressed.

As shown in FIG. 35, when the second abutting surface 785*e* of the third operating member 78*e* presses against the first abutting surface 745*e* of the pushing member 74*e*, the pushing member 74*e* presses the positioning member 73*e*, so that the positioning member 73*e* is completely separated from the positioning hole 71*e*. That is, the restricting mechanism is in an unlocking state. The supporting member 42 can move axially with respect to the housing 1.

In this case, the other hand pushes the output shaft 4 inward or pulls the output shaft 4 outward, or the output shaft is moved axially by using another external force (for example, the tool bit is pressed against the work piece), so as to adjust the length of the output shaft 4 extending out of the housing 1. When the output shaft 4 is located in an appropriate working position, the third operating member 78*e* is pushed to move forward, the second abutting surface 785*e* of the third operating member 78*e* is driven away from the first abutting surface 745*e* of the pushing member 74*e*, the first inclined surface 746*e* of the pushing member 74*e* presses against the second inclined surface 786*e* of the third operating member 78*e*, and the second elastic member 75*e* makes the pushing member 74*e* move outward radially; at the same time, the third elastic member 731*e* is stretched, the positioning member 73*e* moves outward radially and is embedded in the positioning hole 71*e*, thereby implementing the axial locking of the output shaft. In this case, the work of tightening up the screw may be conducted by pressing the button switch 19.

Figure 37:
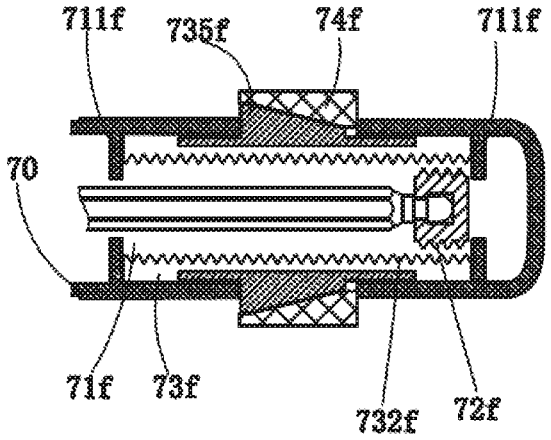
FIG. 37 is a schematic sectional structural diagram of a restricting mechanism of a power tool according to a tenth preferred implementation manner of the present invention.

FIG. 37 shows a ninth preferred implementation manner of the present invention, in the ninth implementation manner, structures and functions of the housing, the motor, the transmission mechanism, the output shaft, the support block, the button switch and the like are the same as those in the fourth implementation manner, and are not repeated herein.

Figure 39:
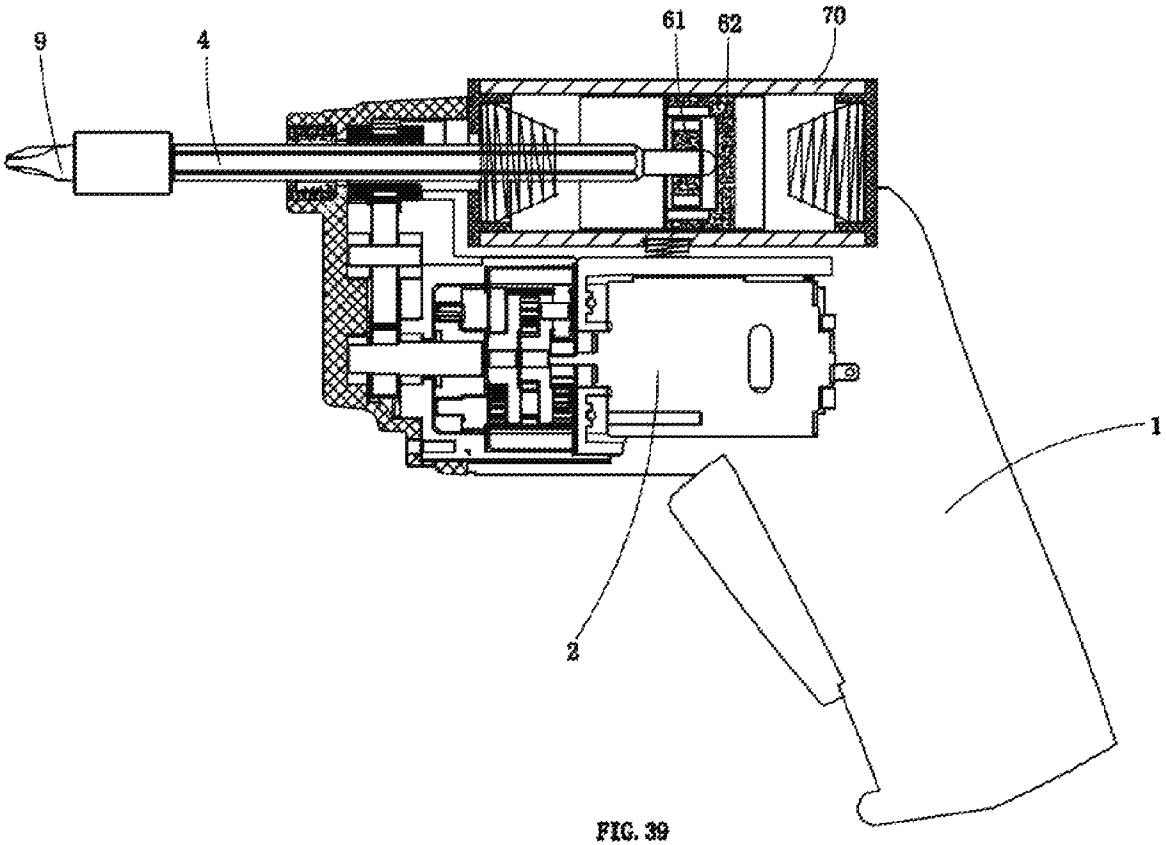
FIG. 39 is a schematic sectional diagram of a power tool according to a twelfth preferred implementation manner of the present invention.

Referring to FIG. 39, the positioning part is a positioning slot 71*f* disposed on the reference member 70; the locking part is a restricting tooth 72*f* disposed on the supporting member 42; and the positioning member 73*f* is located in the positioning slot 71*f*, and has at least two restricting tooth portions 732*f* restricting axial movement of the restricting tooth 72*f*.

Specifically, the reference member 70 is provided with two positioning member baffles 711*f*, and a positioning slot 71*f* is formed between the two positioning member baffles 711*f* with the reference member 70. That is, the positioning member 73*f* is located between the two positioning member baffles 711*f*, and the positioning member 73*f* is axially static with respect to the reference member 70.

The restricting tooth 72*f* is disposed on the radial external surface of the support block 4.

Correspondingly, the restricting tooth portion 732*f* is located at an inward end of the positioning member 73*f* in the radial direction, and is opposite to the restricting tooth 72*f*. The restricting tooth portion 732*f* is arranged in the axial direction. The number of the restricting tooth portions 732*f* is one-to-one corresponding to the working positions of the output shaft 4.

The restricting tooth 72*f* is in a shape of a sharp tooth, and definitely, a square tooth and an arced tooth are also available.

The positioning member 73*f* is located in the positioning slot 71*f*, cannot move axially, but can move radially.

The positioning control assembly includes a positioning member reset unit.

The positioning member reset unit is specifically a fourth elastic member (not shown). The fourth elastic member is located between the positioning member 73*f* and the reference member 70, and the elastic force of the fourth elastic member makes the positioning member 73*f* move outward in the radial direction, that is, move radially toward the external direction of the reference member 70.

Definitely, the fourth elastic member is located between one end of the positioning member 73*f* away from the restricting tooth portion 732*f* and the internal surface of the reference member 70.

Further, the positioning control assembly includes a pushing member 74*f* movable axially, and the pushing member 74*f* controls the restricting tooth 72*f* to be engaged with and separated from the restricting tooth portion 732*f*.

The pushing member 74*f* has a locking position segment, an unlocking position segment and a transition position in the axial direction; when the pushing member 74*f* is axially located in the transition position, the positioning member moves radially. When the pushing member 74*f* is axially located in the locking position segment, the positioning member is static radially, and keeps an engaged state of the restricting tooth 72*f* and the restricting tooth portion 732*f*; in this case, the support block 42 and the positioning member 73*f* are relatively static in the axial direction, so that the output shaft 4 and the reference member 70 are locked axially, that is, the output shaft 4 cannot move axially in the housing 1. When the pushing member 74*f* is axially located in the unlocking position segment, the positioning member is static in the radial direction, and keeps a separated state of the restricting tooth 72*f* and the restricting tooth portion 732*f*; in this case, the support block 42 can move axially with respect to the positioning member 73*f*, so that the output shaft 4 and the reference member 70 are unlocked axially, and the output shaft 4 can move axially in the housing 1.

The pushing member 74*f* is located at the outer side of the housing, and has a guide surface. The guide surface converts the axial movement of the pushing member into radial movement of the positioning member. The guide surface is a third inclined surface.

Specifically, further, the positioning member 73*f* has an inclined surface block 735*f*; the inclined surface block 735*f* is located at a radial end portion of the positioning member 73*f* near the reference member 70, and correspondingly, the reference member 70 is provided with a hole for the inclined surface block 735*f* to pass through. The inclined surface block 735*f* passes through the hole and extends out of the reference member 70, and the radial outer end of the inclined surface block is provided with a fourth inclined surface.

The pushing member presses the fourth inclined surface with the third inclined surface to implement the engagement and separation of the restricting tooth 72*f* and the restricting tooth portion 732*f*.

The fourth inclined surface and the third inclined surface may be relatively static under the effect of the static friction force. Specifically, there is a large static friction force between the fourth inclined surface and the third inclined surface, and during operation of the operator, the pushing member 74*f* overcomes the static friction force between the fourth inclined surface and the third inclined surface, so that the third inclined surface slides with respect to the fourth inclined surface, and therefore, the pushing member 74*f* moves axially. When the operator releases the action force applied to the pushing member 74*f*, the pushing member 74*f* is static with respect to the inclined surface block under the effect of the static friction force between the fourth inclined surface and the third inclined surface, so that the positioning member 73*f* keeps static in the radial direction.

As shown in FIG. 37, the operator operates the pushing member 74*f* to move forward axially, the fourth inclined surface presses the third inclined surface, the third inclined surface moves inward radially, so as to drive the positioning member 43*f* to move inward radially, and therefore, the restricting tooth portion 732*f* approaches to the restricting tooth 72*f*, until the restricting tooth 72*f* is engaged with the restricting tooth portion 732*f*. The action force applied to the pushing member 74*f* is released, the pushing member 74*f* stops moving under the effect of the static friction force between the fourth inclined surface and the third inclined surface, that is, it cannot move backward axially, thereby keeping the engaged state of the restricting tooth 72*f* and the restricting tooth portion 732*f*.

The process of quick switch of a working state of the output shaft in the tenth implementation manner of an electric screw driver according to the present invention is described in detail.

When the output shaft 4 is in a working position, that is, the restricting tooth 72*f* is engaged with the restricting tooth portion 732*f*, in this case, the work of tightening up a screw may be conducted by pressing the button switch 19. In this case, the motor drives, through the transmission mechanism, the output shaft 4 to rotate, and the output shaft 4 drives the tool bit to rotate.

Referring to FIG. 37, when the length of the output shaft 4 extending out of the housing 1 needs to be adjusted, in this case, the operator pushes the pushing member 74*f* to move backward along the chute on the housing 1; the fourth inclined surface of the pushing member 74*f* is also moved backward, and the third inclined surface moves outward radially under the effect of the second elastic member, so that the restricting tooth portion 732*f* on the positioning member 73*f* is separated from the restricting tooth 72*f*, in this case, the output shaft 4 can move axially. The other hand pushes the output shaft 4 inward or pulls the output shaft 4 outward, so as to adjust the length of the output shaft 4 extending out of the housing 1.

When the output shaft 4 is located in an appropriate working position, the pushing member 74*f* is pushed to move forward, the fourth inclined surface of the pushing member 74*f* is also pushed to move forward, the fourth inclined surface presses the third inclined surface to move inward radially, and the second elastic member is compressed. At the same time, the restricting tooth portion 732*f* on the positioning member 73*f* approaches to the restricting tooth 72*f*, until the restricting tooth portion 732*f* is engaged with the restricting tooth 72*f*. The acting force applied to the pushing member 74*f* is released, and under the effect of the friction force of the third inclined surface and the fourth inclined surface, the pushing member 74*f* does not move, and the output shaft 4 keeps axial locking. Working can be conducted by pressing the button switch 19.

Figure 38:
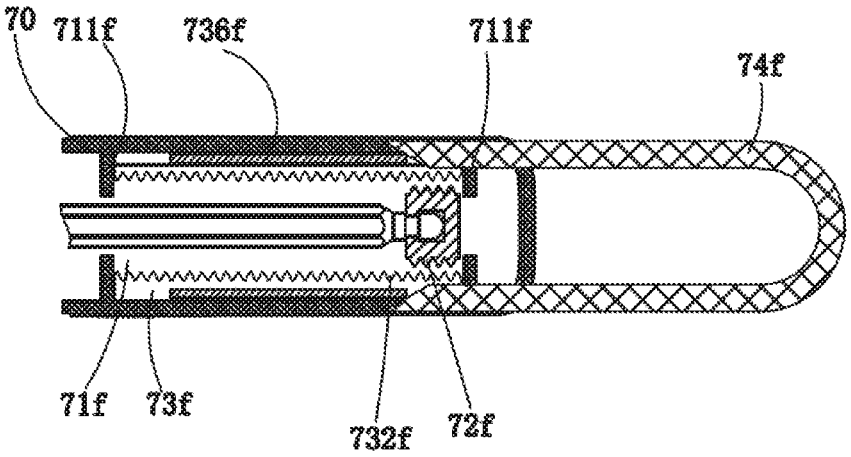
FIG. 38 is a schematic sectional structural diagram of a restricting mechanism of a power tool according to an eleventh preferred implementation manner of the present invention.

FIG. 38 shows an eleventh preferred implementation manner of the present invention, different from the tenth implementation manner, the control relation of the pushing member 74*f* and the positioning member 73*f* is different. Others are all the same as those in the tenth implementation manner.

In the implementation manner, the positioning control assembly further includes a movement guiding block 736*f* disposed on the positioning member 73*f*, and the movement guiding block 736*f* has a radial end portion and an axial end portion.

Correspondingly, the pushing member 74*f* has a plane and a guide surface. The plane is parallel to the axial direction, that is, the axis of the output shaft. Specifically, the pushing member 74*f* is U-shaped, an opening end of the U shape has an inclined surface, the plane is located at an inner wall of the U shape, and the guide surface is the inclined surface at the opening end.

When the plane of the pushing member 74*f* is located at the outer side of the radial end portion of the movement guiding block 736*f*, the plane restricts the radial movement of the movement guiding block 736*f*, in this case, the restricting tooth 72*f* is engaged with the restricting tooth portion 732*f*, and the output shaft 4 is locked axially; when the pushing member 74*f* moves axially so that the guide surface thereof contacts with the axial end portion of the movement guiding block 736*f*, the axial movement of the pushing member 74*f* is converted to the radial movement of the movement guiding block, so that the restricting tooth is separated from the restricting tooth portion, and the output shaft can move axially.

The process of quick switch of a working state of the output shaft in the eleventh implementation manner of an electric screw driver according to the present invention is described in detail.

When the output shaft 4 is in a working position, that is, the restricting tooth 72*f* is engaged with the restricting tooth portion 732*f*, in this case, the work of tightening up a screw may be conducted by pressing the button switch 19. In this case, the motor drives, through the transmission mechanism, the output shaft 4 to rotate, and the output shaft 4 drives the tool bit to rotate.

Referring to FIG. 38, when the length of the output shaft 4 extending out of the housing 1 needs to be adjusted, in this case, the operator pushes the pushing member 74*f* to move backward along the chute on the housing 1; the plane of the pushing member 74*f* is driven to slowly away from the radial end portion of the movement guiding block of the positioning member 73*f*, when the axial end portion of the movement guiding block is moved to the guide surface of the pushing member, under the elastic force of the second elastic member, the positioning member 73*f* can only move radially, the positioning member 73*f* drives the movement guiding block to move outward radially, so that the restricting tooth portion 732*f* on the positioning member 73*f* is separated from the restricting tooth 72*f*. In this case, the output shaft can move axially; the other hand pushes the output shaft 4 inward or pulls the output shaft 4 outward, so as to adjust the length of the output shaft 4 extending out of the housing 1.

When the output shaft 4 is located in an appropriate working position, the pushing member 74*f* is pushed to move forward, the guide surface of the pushing member 74*f* presses the axial end portion of the movement guiding block, and because the positioning member 73*f* can only move radially, the forward pushing of the pushing member is converted into the radial inward movement of the positioning member 73*f*, the restricting tooth portion on the positioning member 73*f* approaches to the restricting tooth, and at the same time, the second elastic member is compressed. When a locking location of the pushing member 74*f* is located at the outer side of the radial end portion of the movement guiding block, the movement guiding block cannot move, in this case, the restricting tooth portion 732*f* is engaged with the restricting tooth 72*f*, and the output shaft is locked axially. Working can be conducted by pressing the button switch 19.

FIG. 39 to FIG. 44 show a twelfth preferred implementation manner of the present invention, and in the twelfth implementation manner, structures and functions of the housing, the motor, the transmission mechanism, the output shaft, the button switch and the like are the same as those in the first implementation manner, and are not repeated herein.

In the twelfth implementation manner, the output shaft is provided with a preset region in the axial direction, and the working position may selectively be any position in the preset region. The preset region is located between a working position closest to the motor and a working position farthest to the motor. In other words, in an adjustable range, any position of the output shaft may implement the axial locking and output the rotary power, that is, any position in the adjustable range may be used as a working position. The working positions of the output shaft are successive. That is, there is no interval between the working positions, and the number of the working positions is infinite.

Referring to FIG. 39, and FIG. 41 to FIG. 44, the restricting mechanism includes a reference member 70, a positioning member 62, and a locking member 61.

The locking member 61 is fixed on the output shaft 4, the reference member 70 is mounted on the housing 1, and there is no relative rotation between the reference member 70 and the housing 1.

The positioning member 62 is disposed between the locking member 61 and the reference member 70, and the positioning member 62 and the locking member 61 keep axial static, that is, the positioning member 62 and the output shaft 4 have no relative shift in the axial direction.

The inner wall of the reference member 70 is provided with a positioning part 631. The positioning part 631 may convert the rotation movement of the positioning member 62 into the axial movement of the positioning member 62 with respect to the positioning part 631.

Figure 41:
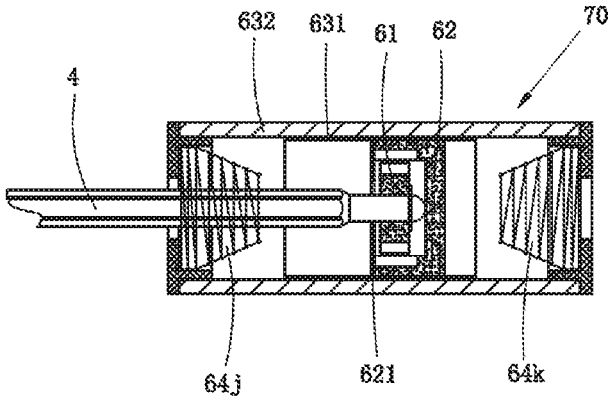
FIG. 41 is a schematic state diagram in FIG. 39 when the restricting mechanism locking member is separated from the positioning member.
Figure 42:
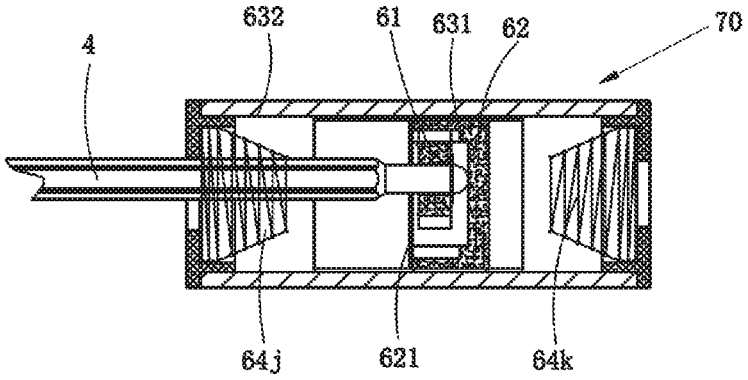
FIG. 42 is a schematic state diagram in FIG. 39 when the restricting mechanism locking member is engaged with the positioning member.

The state between the locking member 61 and the positioning member 62 is a radial engaged state or a radial separated state; when the locking member 61 and the positioning member 62 are radially engaged, for example, the state shown in FIG. 42, the output shaft 4 drives the positioning member 62 to rotate, and the positioning member 62 converts, through the positioning part 631, the rotary movement thereof into the axial movement with respect to the positioning part 631. The output shaft 4 and the positioning member 62 are relatively static axially, and therefore, the output shaft 4 can move axially with respect to the positioning part 631, that is, stretching or retraction of the output shaft 4 is implemented. When the locking member 61 and the positioning member 62 are radially separated, for example, the state shown in FIG. 41, the output shaft 4 cannot drive the positioning member 62 to rotate, the positioning member 62 does not rotate and is axially locked to the positioning part 631. Likewise, the output shaft 4 and the positioning member 62 are relatively static axially, and therefore, the output shaft 4 cannot move axially with respect to the positioning part 631, that is, the output shaft 4 is restricted from moving axially.

Specifically, the positioning member 62 is provided with a baffle 621, and the baffle 621 restricts the locking member 61 from moving axially with respect to the positioning member 62.

Referring to FIG. 41 to FIG. 44, the locking member 61 is located between the baffle and a body of the positioning member, and the baffle 621 restricts the locking member 62 from moving axially.

Specifically, the locking member 61 is provided with a gear part, and the gear part is located on the radial peripheral surface of the locking member 6. Correspondingly, the positioning member has a gear ring part matching with the gear part. When the gear part and the gear ring part are engaged radially, the rotation of the output shaft 4 powers the gear part on the locking member, so as to drive the gear ring part on the positioning member to rotate. When the gear part and the gear ring part are separated radially, the rotary power of the output shaft 4 cannot be transmitted to the positioning member, and the positioning member 62 does not rotate.

The positioning member 62 and the positioning part 631 are in threaded connection.

Specifically, a portion of the positioning member 62 contacting with the reference member 70 is provided a thread, that is, the periphery of the positioning member 62 is provided with a thread. Correspondingly, the positioning part 631 has an internal thread matching with the thread.

The reference member 70 may be in a hollow cylindrical structure, and the positioning member 62 is disposed in the reference member 70. An inner wall of the axial middle region of the reference member 70 is provided with an inner thread, so as to form the positioning part. Further, an inner thread may also be provided on a part of the surface of the inner wall to form the positioning part, and in a cross section perpendicular to the axial direction, the positioning part is projected as an arc.

Definitely, the positioning part may also be several teeth matching with the thread of the positioning member 62.

When the locking member 61 and the positioning member 62 are radially engaged, the positioning member 62 converts, through the thread, the rotary movement into the axial movement of the positioning member 62 with respect to the positioning part 63.

When the locking member 61 and the positioning member 62 are separated, by means of the locking of the thread, the axial position of the positioning member 62 with respect to the positioning part 631 is unchanged, and in this case, the reference member 70 and the positioning member 62 merely function for supporting.

Definitely, the implementation manner is not limited to the threaded structure, and other structures that can implement conversion from rotation to axial movement are also available.

In the implementation manner, by means of the rotation of the output shaft, the axial movement of the output shaft can be implemented, and the adjustment of the output shaft is automatically implemented by the force of the motor, so that the operation is more convenient.

The reference member 70 further includes an idling part 632. When the positioning member 62 moves to the idling part 632 of the reference member 62, the idling part cannot implement conversion from rotation to axial movement, the rotation of the positioning member 62 cannot generate axial shift at the idling part 632, and keeps static in the axial direction. Therefore, the idling part 632 can inhibit the continuous axial shift of the positioning member 62. If the positioning member 62 keeps moving axially, it will damage the housing or other accessories. By means of the idling structure, the idling part 632 inhibits the further axial shift of the positioning member 62, thereby protecting the housing and other accessories.

Specifically, the idling part 632 is located at two axial sides of the positioning part 631; in this way, when the output shaft moves toward the tool bit and moves away from the tool bit, protection may be conducted in both conditions.

The restricting mechanism further includes an elastic member, and the elastic force of the elastic member makes the positioning member 62 move toward the positioning part 631. The elastic member is referred to as a sixth elastic member.

The sixth elastic member may be a compressed spring, a blade spring, and the like, and in the implementation manner, a compressed spring is used.

When the positioning member 62 is driven away from the boundary of the positioning part 631 to the idling part 632, it stops moving axially, the positioning member 62 will compress the sixth elastic member 64*j*, 64. The sixth elastic member 64*j*, 64*k* is compressed and has a movement trend of spring back, so as to provide an initial acting force for the reverse motion of the positioning member 62. In the implementation manner, when the positioning member 62 is driven away from the boundary of the positioning part 631 to the idling part 632, the sixth elastic member 64*j*, 64*k* is compressed, and the sixth elastic member 64*j*, 64*k* is at the elastic compression limit; therefore, when the positioning member 62 moves to a reversed direction, the maximum initial acting force may be provided.

Specifically, the sixth elastic members 64*j*, 64*k* are disposed at two ends inside the reference member 70 in the axial direction.

The reference member 70 can move radially. The reference member 70 drives the positioning member 62 to move radially, and since the locking member 61 is disposed on the output shaft 4, the locking member 61 cannot move radially. When the reference member 70 moves inward radially (that is, in the direction near the output shaft), the reference member 70 drives the positioning member 62 to move inward as well, thereby implementing the radial engagement of the locking member 61 and the positioning member 62. When the reference member 70 moves outward radially, the reference member 70 also drives the positioning member 62 to move outward (that is, in the direction away from the output shaft), thereby implementing the radial separation of the locking member 61 and the positioning member 62.

The radial movement of the reference member 70 may be radial movement in a horizontal plane, or radial movement in a vertical plane, and definitely, and may also be radial movement in other angles. In the implementation manner, the radial movement in the vertical plane is used as an example.

Figure 40:
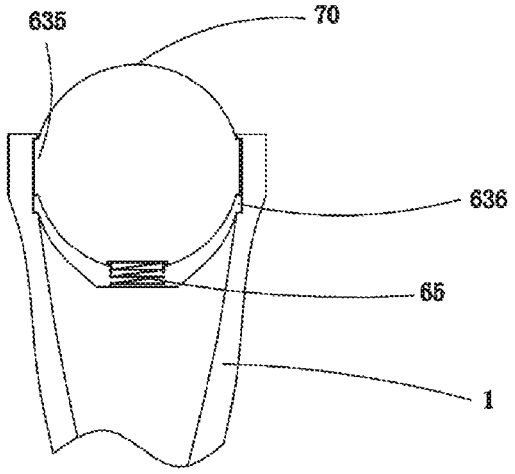
FIG. 40 is a schematic partial back diagram of the power tool in FIG. 39.

Specifically, referring to FIG. 40, FIG. 40 is a partial rear diagram of the preferred implementation manner. In FIG. 40, the handle part is omitted, an accommodation slot for partially accommodating the reference member 70 is disposed on the housing 1, and the accommodation slot is located at the upper portion of the housing 1. The inner wall of the accommodation slot is provided with a radially distributed guide rail 636, the reference member 70 is provided with a positioning sliding block 635 corresponding to the guide rail 636, the positioning sliding block 635 is embedded in the guide rail 636, and the positioning sliding block 635 drives the reference member 70 to slide on the guide rail 636 in the radial direction. The output shaft 4 and the locking member 61 will not shift radially with respect to the housing 1, and the positioning member 62 and the reference member 70 can move radially with respect to the output shaft, so that the locking member 61 and the positioning member 62 are engaged radially. When the locking member 61 and the positioning member are in a radially engaged state, the rotation of the output shaft 4 drives the positioning member 62 to move, so as to drive the output shaft 4 to stretch or retract.

An elastic member is further disposed between the reference member 70 and the housing 1, and is referred to as a seventh elastic member. The seventh elastic member 65 may be a compressed spring or a blade spring, and in the implementation manner, a compressed spring is used.

The objective of disposing the seventh elastic member lies in that, when the locking member 61 and the positioning member 62 are separated, the seventh elastic member 65 supports the reference member 70, and the reference member 70 will not move downward due to the gravity of the reference member 70, so that the locking member 61 and the positioning member 62 are engaged radially.

Specifically, the seventh elastic member 65 is disposed at the bottom portion of the accommodation slot.

In the implementation manner, the reference member 70 is pushed manually to move radially, two ends of the guide rail 636 are provided with bayonets, and when the reference member 70 moves to the bayonet, the bayonet clamps the positioning sliding block 635, so that the reference member 70 does not shift radially with respect to the housing 1. Definitely, the movement of the reference member 70 in the radial direction may further be implemented by using a motor such as an electric motor or a linear step motor, but the manual manner prevents increasing the volume of the electric tool so that the tool is convenient to carry; moreover, no electric connection is added, thereby reducing failures.

Definitely, the radial movement of the reference member may also be radial movement in the horizontal plane.

Figure 43:
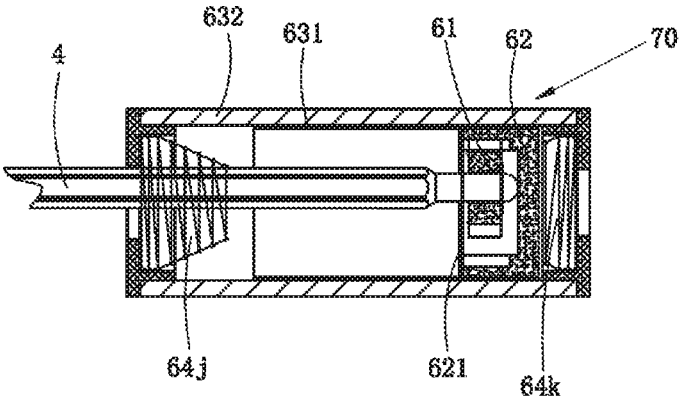
FIG. 43 is a schematic diagram of the output shaft in FIG. 39 when being retracted.
Figure 44:
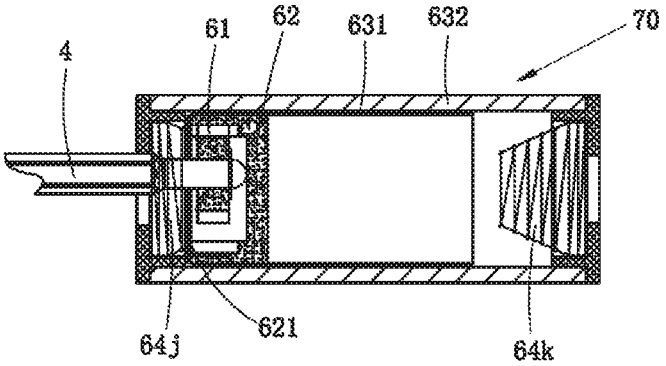
FIG. 44 is a schematic diagram of the output shaft in FIG. 39 when being stretched.

Referring to FIG. 39 together with FIG. 41 to FIG. 44, a working process when the reference member moves downward is described in detail, and FIG. 41 to FIG. 44 are schematic partial diagrams of the working process of the implementation manner. FIG. 41 is a schematic state diagram when the positioning member and the locking member 61 are radially separated, and the reference member 70 is supported by the seventh elastic member 65, so that the positioning member in the reference member 70 is in a radial separated state with the locking member 61. FIG. 42 is a schematic state diagram after the positioning member 63 moves downward and is radially engaged with the locking member 61, the output shaft 4 is in an idling state, the reference member 70 is moved downward, the positioning member 62 is also moved downward, and the locking member 61 and the positioning member 62 are engaged radially. FIG. 43 is a state diagram when the output shaft 4 retracts backward, when the output shaft 4 is idled, the output shaft 4 rotates forward, the locking member 61 rotates along with the output shaft 4, the locking member 61 and the positioning member 62 are engaged radially, the positioning member 62 moves backward in the positioning part 631 until reaching the idling part 632, and the sixth elastic member 64*k* is compressed. FIG. 6 is a state diagram of the output shaft 4 stretching forward, when the output shaft 4 is idled, the output shaft 4 rotates backward, the locking member 61 rotates along with the output shaft 4, the locking member 61 and the positioning member 62 are engaged radially, the positioning member 62 moves forward in the positioning part 631 until reaching the idling part 632, and the sixth elastic member 64*j* at the front end of the reference member 70 is compressed.

When the electric tool is loaded for work, the reference member 70 is removed from the bayonet, the reference member 70 is supported by the seventh elastic member 65, the positioning member and the locking member 61 are kept in a separated state, and the output shaft 4 can be loaded for work.

A specific process when the reference member 70 moves upward may be obtained with reference to the above working process.

By means of the descriptions on the implementation manners of the present invention, it can be understood that, the core idea of the present invention lies in that by setting the output shaft in different working positions, the tool bit may have different extension length, thereby meeting requirements in different working conditions.

The axial direction and radial direction described above are the axial direction and the radial direction of the output shaft, unless specified.

Definitions on various elements are not limited to the specific structures or shapes mentioned in the implementation manners, and they may be replaced by persons of ordinary skill in the art in a simple and well-known manner. Configurations may be changed correspondingly according to different layouts, new elements may be added, and unnecessary elements may also be reduced.

It will be obvious to those having skill in the art that many changes may be made to the details of the above-described embodiments without departing from the underlying principles of the invention. The scope of the present invention should, therefore, be determined only by the following claims.

The invention claimed is:

1. A power tool comprising:

a housing;

a motor arranged in the housing and being configured to be capable of outputting a rotary force; and an output shaft being configured to be rotatably driven by the motor, the output shaft having a first output end for coupling with a tool bit and a second terminal end opposite to the first output end;

wherein the output shaft is parallel to and spaced apart from a rotation axis of the motor; an axial movement of the output shaft along a first axial direction is restricted when the power tool is in a working status, the first axial direction is a direction from the first output end to the second terminal end, wherein in the working status, the first output end of the output shaft is distal to the housing, wherein when the power tool is in a non-working status, the output shaft is configured to be axially movable with respect to the housing to at least two working positions, wherein at each of the at least two working positions, the output shaft is capable of outputting rotation to the tool bit under load.

2. The power tool according to claim 1, wherein the power tool further comprises a restricting mechanism being configured to be in a releasing status and a locking status, the axial movement of the output shaft along the first direction is restricted when the restricting mechanism is in the locking status.

3. The power tool according to claim 2, wherein the power tool comprises a frame member axially fixed in the housing and a locking member coupled to the output shaft; the restricting mechanism comprises a positioning part disposed in the frame member, a locking part disposed in the locking member, and a positioning member being capable of locking or releasing the positioning part and the locking part in the axial direction of the output shaft; the positioning member is configured to be in a first position on where the positioning part and the locking part are locked and a second position from where the locking of the positioning part and the locking part are released.

4. The power tool according to claim 3, wherein the frame member is fixed in the housing and the second terminal end of the output shaft is rotatably supported on the locking member which drives the output shaft to move axially.

5. The power tool according to claim 3, wherein the frame member is circumferentially fixed in the housing.

6. The power tool according to claim 5, wherein the locking member and the positioning member are static with respect to each other in the axial direction of the output shaft; when the locking member is engaged with the positioning member in the radial direction of the output shaft, the output shaft is capable of driving the locking member to rotate, the locking member is capable of driving the positioning member to rotate, and the positioning member is movable with respect to the positioning part along the axial direction of the output shaft; when the locking member is disengaged from the positioning member along the radial direction of the output shaft, the positioning member and the positioning part are locked in the axial direction of the output shaft.

7. The power tool according to claim 6, wherein the frame member is configured to be movable along the radial direction of the output shaft with respect to the housing, the frame member is configured to drive the positioning member moving along the radial direction of the output shaft, so that the positioning member and the locking part are engaged or disengaged.

8. The power tool according to claim 6, wherein the output shaft and positioning part are static with respect to each other in the axial direction of the output shaft when the position part moves to be disengaged with the position member.

* * * * *